US009562746B2

(12) United States Patent
Khandelwal

(10) Patent No.: US 9,562,746 B2
(45) Date of Patent: Feb. 7, 2017

(54) QUICKLY RELEASABLE VEST

(71) Applicant: MKU PVT LTD, Kanpur-UP (IN)

(72) Inventor: Manish Khandelwal, Kanpur (IN)

(73) Assignee: MKU PVT LTD, Kanpur (IN)

( * ) Notice: Subject to any disclaimer, the term of this patent is extended or adjusted under 35 U.S.C. 154(b) by 350 days.

(21) Appl. No.: 14/028,468

(22) Filed: Sep. 16, 2013

(65) Prior Publication Data

US 2014/0208475 A1 Jul. 31, 2014

Related U.S. Application Data

(63) Continuation-in-part of application No. 12/518,202, filed on Oct. 27, 2009, now Pat. No. 8,533,862.

(51) Int. Cl.
*F41H 1/02* (2006.01)

(52) U.S. Cl.
CPC ..... *F41H 1/02* (2013.01)

(58) Field of Classification Search
CPC ..... Y10T 24/45524; Y10T 24/45529; Y10T 25/4736; Y10T 24/4501; Y10T 24/45241; A44B 11/266; F41H 1/00; F41H 1/02; A41D 13/0518; A41D 13/055; A41D 1/04
USPC ..... 2/2.5
See application file for complete search history.

(56) References Cited

U.S. PATENT DOCUMENTS 4,044,478 A 8/1977 Girard
5,310,378 A 5/1994 Shannon
5,311,649 A * 5/1994 Suh ..... A44B 11/266 24/616
5,822,792 A 10/1998 Reinhart, Jr.
6,032,289 A 3/2000 Villapiano
6,163,884 A 12/2000 Rosch et al.
6,487,761 B2 * 12/2002 Van Tassel ..... A44B 11/266 24/606
7,144,086 B1 12/2006 Harcourt et al.
(Continued)

FOREIGN PATENT DOCUMENTS

GB 577 157 A 5/1946
JP 2006017332 1/2006
(Continued)

OTHER PUBLICATIONS

International Application No. PCT/US2014/055713, International Search Report and Written Opinion mailed Dec. 30, 2014.

*Primary Examiner* — Andrew W Collins
(74) *Attorney, Agent, or Firm* — Sheppard, Mullin, Richter & Hampton LLP

(57) ABSTRACT

A quickly releasable vest capable of protecting a torso portion of a user is disclosed. The quickly releasable vest includes a self locking buckle assembly, a ferrule, an elongated strip, and a socket member. The self locking buckle assembly comprises a wedge fork with a base portion and a body portion, the base portion comprising a security means for webbing and the body portion comprising a pair of legs and a ferrule guide member. The ferrule is adapted to be slidingly disposed on the ferrule guide member. A proximal end portion of the strip is connected to a tape guide member of the ferrule. An opening on the socket member facilitates removably retaining and locking of a prong on each of the pair of legs. The wedge fork, ferrule, and elongated strip Is disposed on a torso panel and the socket member is disposed on the other torso panel.

16 Claims, 23 Drawing Sheets

(56) References Cited

U.S. PATENT DOCUMENTS

| | | | | |
|---|---|---|---|---|
| 7,168,133 | B2 | 1/2007 | Luo et al. | |
| 7,895,719 | B2 | 3/2011 | Woods | |
| 8,196,273 | B2 * | 6/2012 | Anscher | A44B 11/266 24/265 BC |
| 8,533,862 | B2 * | 9/2013 | Khandelwal | F41H 1/02 2/102 |
| 2002/0092140 | A1 | 7/2002 | Van Tassel | |
| 2002/0120973 | A1 | 9/2002 | D'Annunzio | |
| 2002/0133922 | A1 | 9/2002 | Uehara et al. | |
| 2004/0112098 | A1 * | 6/2004 | Bonelli | A44B 11/266 70/58 |
| 2005/0005342 | A1 | 1/2005 | Johnson | |
| 2005/0015837 | A1 | 1/2005 | Saito | |
| 2006/0272136 | A1 * | 12/2006 | Chui | A44B 11/266 24/614 |
| 2008/0230069 | A1 | 9/2008 | Valcic et al. | |
| 2009/0100652 | A1 * | 4/2009 | Mok | A44B 11/266 24/625 |
| 2010/0043112 | A1 | 2/2010 | Khandelwal | |
| 2010/0313392 | A1 | 12/2010 | Anscher | |
| 2011/0099776 | A1 | 5/2011 | Anscher | |
| 2012/0030852 | A1 * | 2/2012 | Anscher | F41H 1/02 2/102 |
| 2012/0174280 | A1 | 7/2012 | Strum et al. | |
| 2012/0297527 | A1 | 11/2012 | Darnell et al. | |
| 2014/0173859 | A1 * | 6/2014 | Anderson | A44B 11/2592 24/598.1 |
| 2014/0208475 | A1 * | 7/2014 | Khandelwal | F41H 1/02 2/2.5 |

FOREIGN PATENT DOCUMENTS

| | | | |
|---|---|---|---|
| WO | 2009093267 | A2 | 7/2009 |
| WO | 2013119294 | A1 | 8/2013 |

* cited by examiner

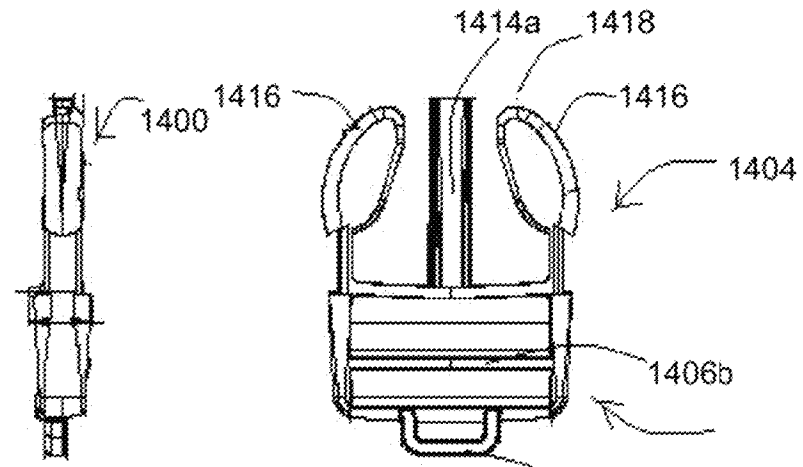
FIG. 20c
FIG. 20d
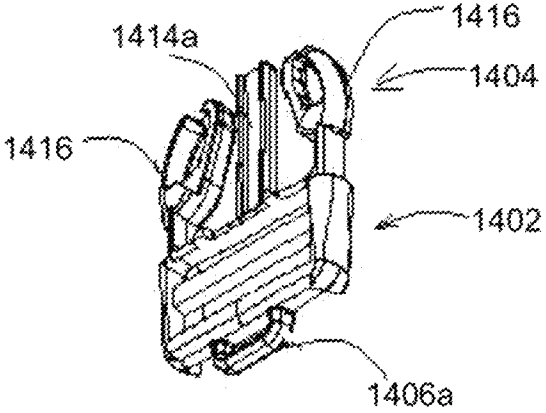
FIG. 20a
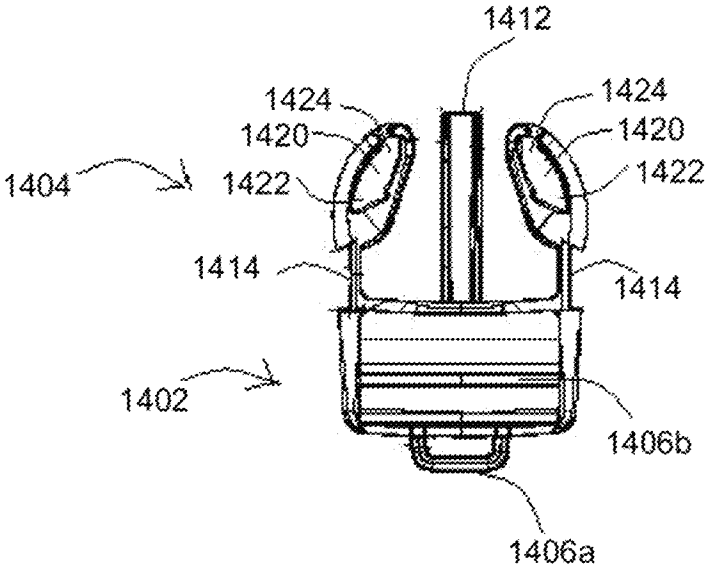
FIG. 20b
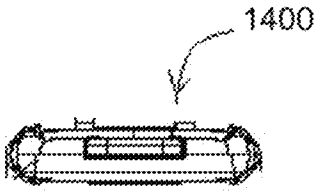
FIG. 20e

QUICKLY RELEASABLE VEST

CROSS-REFERENCES TO RELATED APPLICATIONS

This application is seek priority to and is a continuation-in-part of U.S. patent application Ser. No. 12/518,202, U.S. filing and international filing date of Sep. 17, 2008, titled "Quickly Releasable Vest," which claims the benefit of Indian filed application IN2093/DEL/2007 filed on Oct. 8, 2007, titled "Quickly Releasable Vest" and Indian filed application IN194/DEL/2008 filed on Jan. 23, 2008, titled "A Quick Release Simplified Jacket," the U.S. patent application and the two Indian filed applications being hereby incorporated by reference herein.

FIELD OF THE INVENTION

The present invention relates generally to vests, and, more particularly, to a quickly releasable vest including a buckle assembly.

BACKGROUND OF THE INVENTION

Vests are configured to cover a torso portion of a user. The vests are disposed on the shoulder portion of the user by means of cables, buckles and the like. The vests are of different types such as exercise vests, cooling vests, protective vests and the like. The protective vests are used to protect the torso portion of the user against an impact. The protective vests may also be referred to as bulletproof vests. The bullet proof vests include bullet resistance armor.

The bulletproof vests for military operations worn by soldiers are heavier than the bulletproof vests worn by others like police or security guard because the soldiers need protection from powerful bullets from rifle or machine gun. The soldiers, according to mission, may also require various accessories such as pouches, magazines, water carrier, medical kit, small portable walkie-talkie sets and the like which can be positioned or fixed on the bullet proof vest as per the convenience of the soldier. The various accessories positioned on the bullet proof vest make the bullet proof vest heavy. During various emergency military operations such as, evacuation, running fast in forest or going through water, it will be necessary to quickly separate the vest from the body of the soldier for either better efficiency or to save his life.

Thus there is a need for a vest that is capable of being separated easily from a torso portion of a user.

A fastener is a hardware device configured to join or affix two or more objects together. Moreover, the fastener may be used to close a container such as a bag, a box, or an envelope. The fastener may be configured to removably or permanently join or affix two or more objects together. The fastener configured to removably join or affix two or more objects together may be fastened and unfastened as per a user requirement. The fasteners may be of different types such as a batten, a bolt, a screw, a button, a clip, a buckle and the like.

The buckle may be configured to removably connect two parts of any device together. Further, the buckle may be used for connecting opposite ends of a strap together.

The buckle may be used in various applications such as in wrist watches, in clothing belts, in vests and the like. Specifically, in military vests the buckle may be configured not only to connect the two portions of the vests but also to facilitate protection by locking the two parts of vests together. Generally, separation of buckle halves requires moving two release portion of the buckle toward one another with one hand and pulling the buckle halves apart from each other. Further, such separation of the buckle halves is inconvenient in emergency conditions. Furthermore, various traditional buckles used in military applications are unable to be easily detached in emergency conditions.

Accordingly, there is need for a quickly releasable vest that is capable of being released quickly and at the same time connection provided by a buckle assembly thereof is strong. Further, there is need for a quickly releasable vest including a buckle mechanism that is capable of being easily separated with limited motion of user's hands. Still further, there is need of a quickly releasable vest including a buckle mechanism that is configured to prevent accidental release thereof. Moreover, there is a need of quickly releasable vest including a buckle mechanism that is easy to operate.

SUMMARY OF THE INVENTION

In view of the foregoing disadvantages inherent in the prior art, the general purpose of the present invention is to provide a quickly releasable vest configured to include all the advantages of the prior art, and to overcome the drawbacks inherent therein.

Accordingly, an object of the present disclosure is to provide a quickly releasable vest, which is capable of being dressed in and separated easily by a user.

Yet another object of the present disclosure is to provide a quickly releasable vest, which is capable of being used by the persons such as soldiers, police, security guards and the like involved in military and other tactical operations.

Still another object of the present disclosure is to provide a quickly releasable vest, which is capable of protecting at least a torso portion of a user.

Accordingly, the present disclosure provides a quickly releasable vest capable of protecting a torso portion of a user. The quickly releasable vest includes a first torso panel, a second torso panel, a plurality of plug members, a plurality of socket members and a quick release mechanism. The plurality of plug members is disposed on the first torso panel. The plurality of socket members is disposed on the second torso panel. Each of the plurality of socket members is configured to detachably couple to one of the plurality of plug members disposed on the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first torso panel from the second torso panel.

In another aspect of the present disclosure, the quickly releasable vest includes a first torso panel, a second torso panel, a plurality of plug members, a plurality of socket members and a quick release mechanism. The first torso panel includes a first side portion and a second side portion. The second torso panel includes a first side portion and a second side portion. The first side portion of the second torso panel is releasably coupled to the second side portion of the first torso panel. The plurality of plug members is disposed on the first side portion of the first torso panel. The plurality of socket members is disposed on the second side portion of the second torso panel. Each of the plurality of socket members configured to detachably couple to one of the plurality of plug members disposed on the first side portion of the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first side portion of the first torso panel from the second side portion of the second torso panel.

These together with other aspects of the present disclosure, along with some features of novelty discussed herein, are pointed out with particularity in the claims annexed hereto. For a better understanding, operating advantages, and specific objects attained by its uses, reference should be made to the accompanying drawings and descriptive matter in which there are illustrated exemplary embodiments.

An object of the present disclosure is also to provide a quickly releasable vest that is capable of being released quickly and at the same time connection provided by a buckle assembly thereof is strong.

An object of the present disclosure is to provide a quickly releasable vest including an improved buckle assembly that is robust, strong and yet capable of being released quickly.

Yet another object of the present disclosure is to provide a quickly releasable vest including a buckle assembly, which is capable of being easily separated with limited motion of user's hands.

Still another object of the present disclosure is to provide a quickly releasable vest including a buckle assembly that is configured to prevent accidental release thereof.

Furthermore, yet another object of the present disclosure is to provide a quickly releasable vest including a buckle assembly that is easy to operate.

Accordingly, the present disclosure provides a quickly releasable vest for protecting a torso portion of a user. The quickly releasable vest includes a self locking buckle assembly. In various embodiments, the self locking buckle assembly includes a wedge fork, a ferrule, an elongated strip, and a socket member. An exemplary wedge fork includes a base portion and a body portion. An exemplary base portion includes a securing means for securing a webbing thereto. An exemplary body portion includes a pair of legs and a ferrule guide member. The exemplary pair of legs is adapted to be extending from the base portion. Each of the exemplary pair of legs includes a leg base portion and a prong. An exemplary prong includes a notch portion configured thereon. An exemplary ferrule guide member is adapted to be extending from the base portion and disposed in between the pair of legs. The exemplary ferrule is adapted to be slidingly disposed on the ferrule guide member. The exemplary ferrule includes a narrower end portion, a broader end portion extending from the narrower end portion, and a tape guide member. An exemplary elongated strip includes a proximal end portion and a distal end portion. An exemplary proximal end portion is connected to the tape guide member of the ferrule and the distal end portion adapted to be used for facilitating movement of the ferrule. An exemplary socket member defining a hollow portion and including a first side portion and a second side portion, each of the first side portion and the second side portion includes an opening configured thereon. An exemplary opening is adapted to facilitate removable retaining and locking of the prong of the each of the pair of legs to the socket member. The exemplary wedge fork in combination with the exemplary ferrule and the exemplary elongated strip may be disposed on one of a front torso panel and a rear torso panel and the exemplary socket member may be disposed on other of the front torso panel and the rear torso panel for facilitating quick release of the quickly releasable vest.

Although the present disclosure includes descriptions with reference to specific embodiments, these descriptions are not meant to be construed in a limiting sense. Various modifications of the disclosed embodiments, as well as alternate embodiments, will become apparent to persons skilled in the art upon reference to the description herein. It is therefore contemplated that such modifications can be made without departing from the spirit or scope of the present invention(s) as defined.

BRIEF DESCRIPTION OF THE DRAWINGS

The advantages and features of the present invention(s) will become better understood with reference to the following detailed description and claims taken in conjunction with the accompanying drawings, wherein like elements are identified with like symbols, and in which:

FIG. 20*a* illustrates a perspective view of a wedge fork, according to an embodiment of the present invention(s);

FIG. 20*b* illustrates a top view of the wedge fork depicting one side face of the wedge fork, according to an embodiment of the present invention(s);

FIG. 20*c* illustrates a top view of the wedge work depicting another side face of the wedge fork, according to an embodiment of the present invention(s);

FIG. 20*d* illustrates a side view of the wedge fork, according to an embodiment of the present invention(s);

FIG. 20*e* illustrates an end view of the wedge fork, according to an embodiment of the present invention(s);

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention(s) are not limited to a particular quickly releasable vest and/or buckle assembly, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a quickly releasable vest capable of protecting a torso portion of a user. The quickly releasable vest includes a first torso panel, a second torso panel, a plurality of plug members, a plurality of socket members and a quick release mechanism. The plurality of plug members is disposed on the first torso panel. The plurality of socket members is disposed on the second torso panel. Each of the plurality of socket members is configured to detachably couple to one of the plurality of plug members disposed on the first torso panel. The quick release mechanism is disposed on the first torso panel. The quick release mechanism includes a pull cord and a plurality of connecting tapes. The pull cord includes a proximal end portion and a distal end portion. Each of the plurality of connecting tapes includes a first end portion and a second end portion. The first end portion of the each of the plurality of connecting tapes is coupled to the proximal end portion of the pull cord and the second end portion of the each of the plurality of connecting tapes is coupled to the one of the plurality of plug members. The quick release mechanism is configured to separate the first torso panel from the second torso panel.

Figure 1:
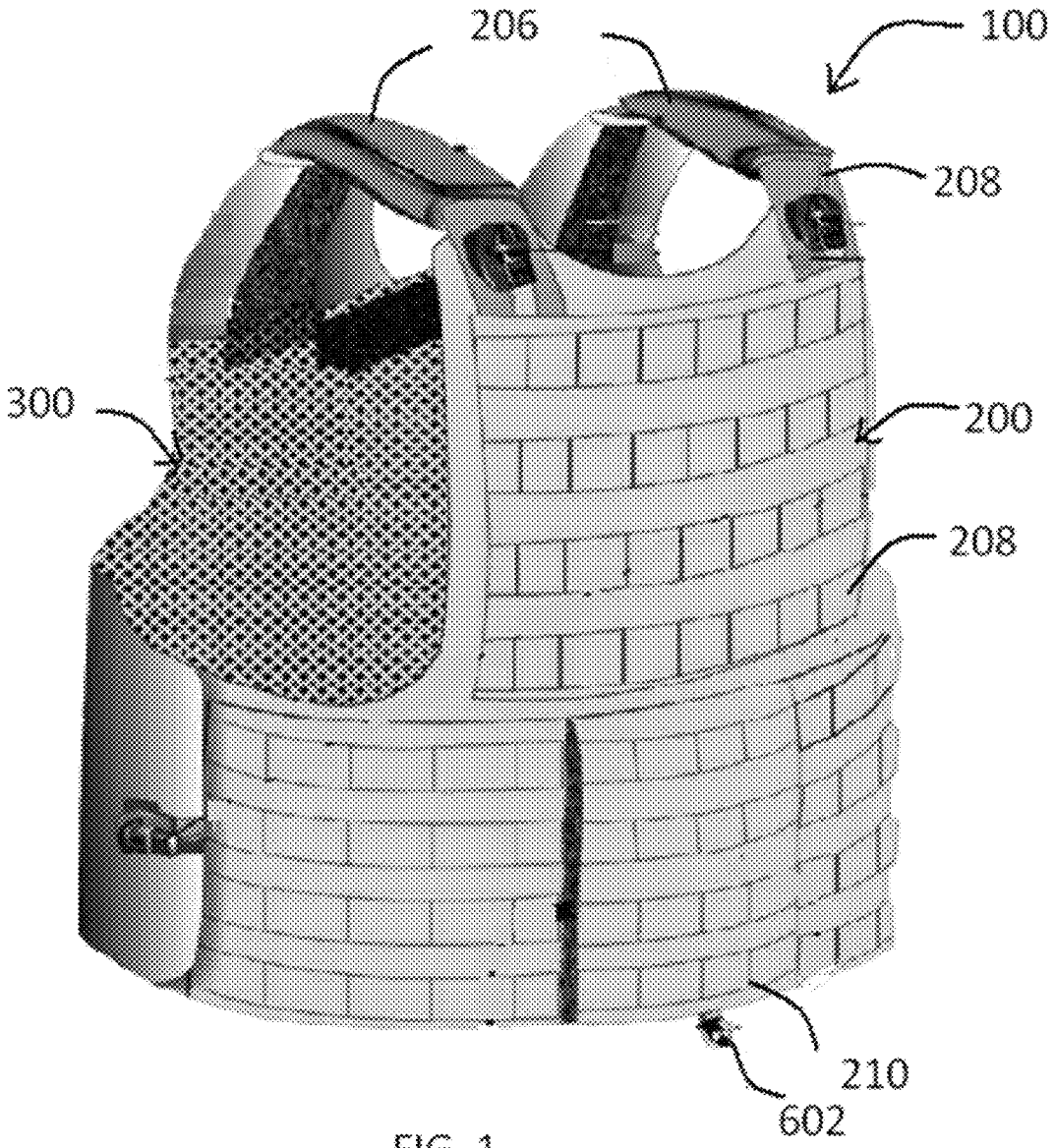
FIG. 1 illustrates a perspective view of a quickly releasable vest including a first torso panel and a second torso panels held together by means of a plurality of plug members and a plurality of socket members, according to an embodiment of the present invention.
Figure 2:
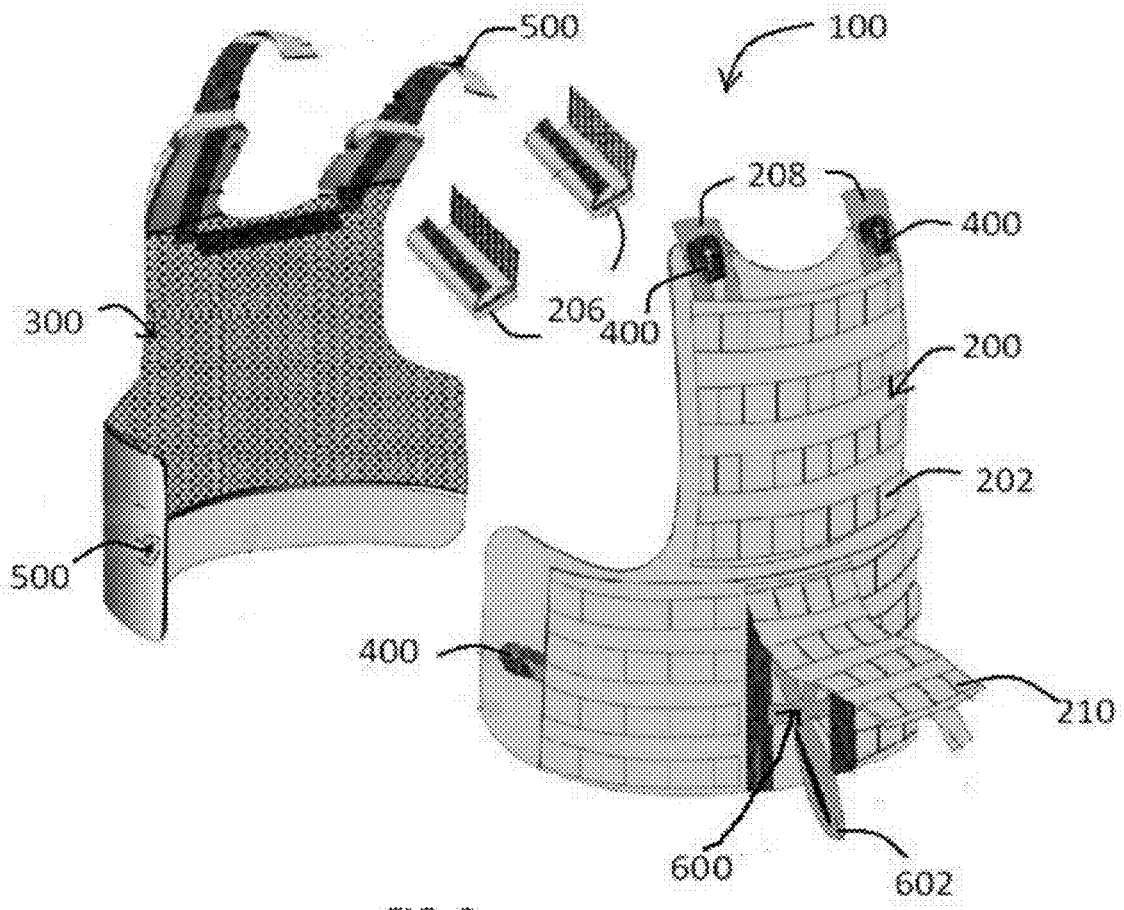
FIG. 2 illustrates a perspective view of a quickly releasable vest including a first torso panel and a second torso panels separated from each away, according to an embodiment of the present invention.
Figure 3:
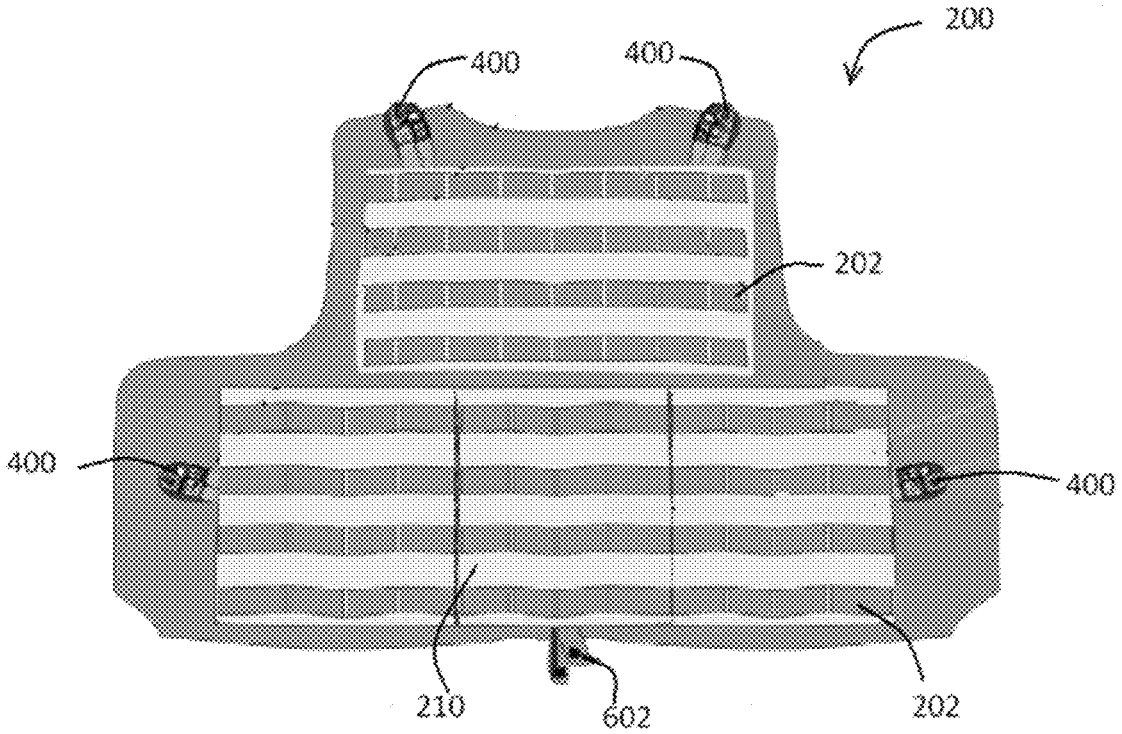
FIG. 3 illustrates a perspective view of an outer surface of the first torso panel of FIG. 1, according to an embodiment of the present invention.

Referring to FIG. 1 and FIG. 2, a quickly releasable vest 100 configured to cover a torso portion of a user in an embodiment of the present invention, is shown. The quickly releasable vest 100 includes a first torso panel 200, a second torso panel 300, a plurality of plug members 400, a plurality of socket members 500 and a quick release mechanism 600 (depicted in FIG. 2).

Further referring to FIG. 1 to FIG. 5B, the first torso panel 200 configured to cover either a front side or a rear side of a torso portion of a user, is shown. In one embodiment of the present invention the first torso panel 200 may cover the front side of the torso portion of the user. In another embodiment of the present invention the first torso panel 200 may cover the rear side of the torso portion of the user. The first torso panel 200 may be made by over lined layers of sewn fabric. In one embodiment of the present invention the first torso panel 200 may accompany a plurality of strips 202, a pair of shoulder pads 206, a pair of shoulder straps 208, a flap 210 and a bullet resistance armor 212.

Figure 4:
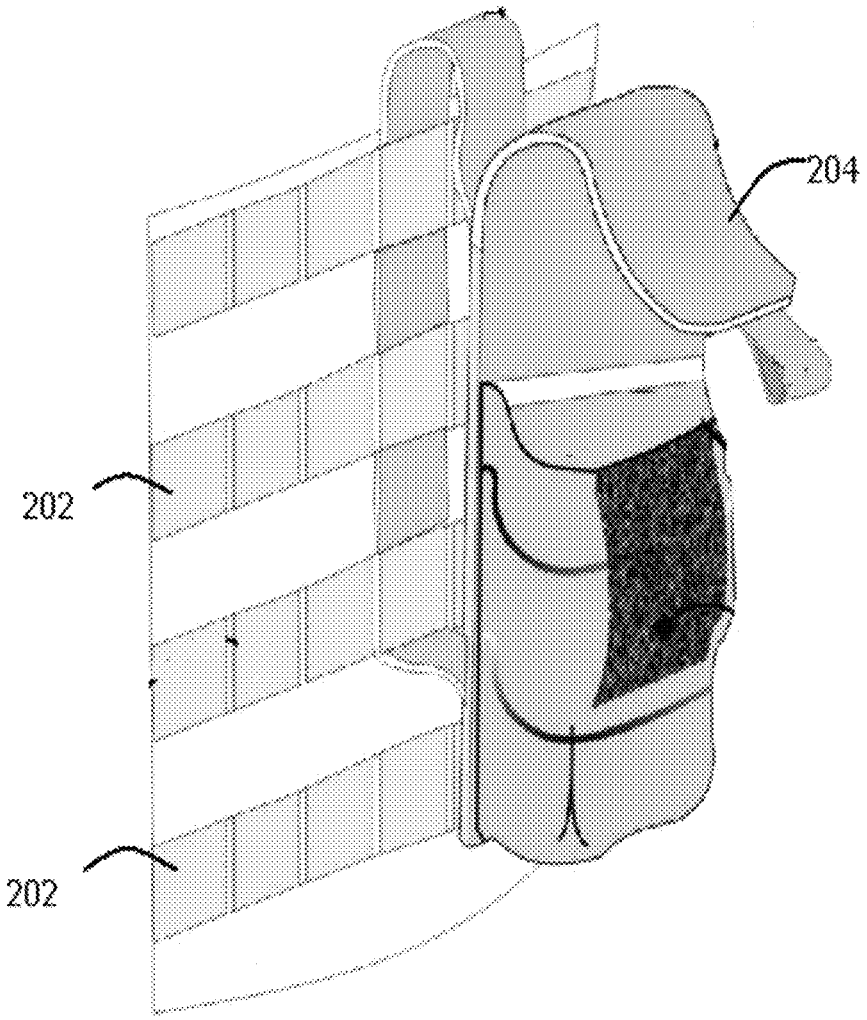
FIG. 4 illustrates a perspective view of a pocket disposed on strips of the first torso panel and the second torso panel for mounting various accessories, according to an embodiment of the present invention.
Figure 5A:
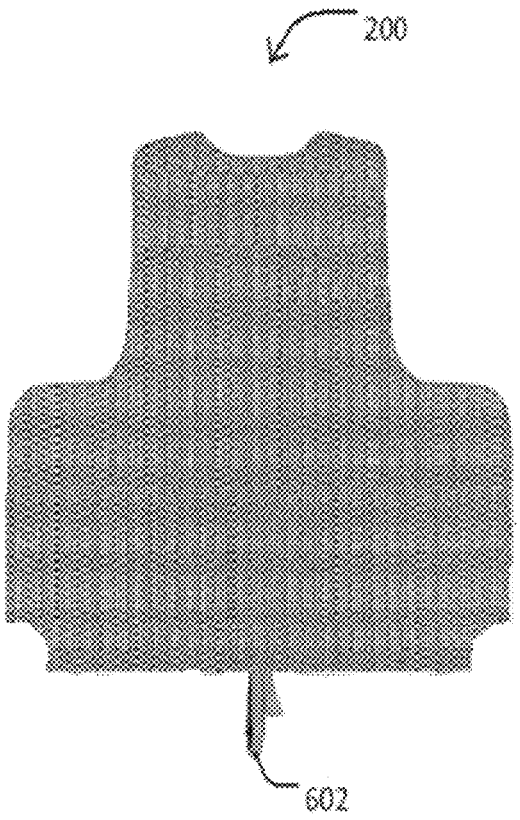
FIG. 5A illustrates a perspective view of an inner surface of a first torso panel, according to an embodiment of the present invention.
Figure 5B:
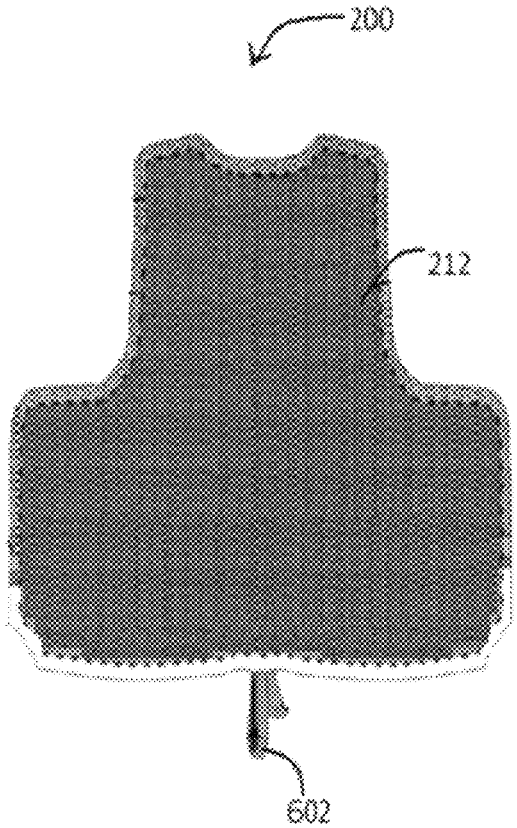
FIG. 5B illustrates a perspective view of an inner surface of a first torso panel with a bullet resistant armor, according to an embodiment of the present invention.

The plurality of strips 202 may be disposed both vertically and horizontally on the first torso panel to accommodate various accessories such as pouches, magazines, water carrier, medical kit, small portable walkie-talkie sets and other similar equipments which can be positioned or fixed as per the convenience of the user. The construction of the plurality of strips 202 permits positioning of accessory pouch etc. at different locations on the first torso panel 200. More specifically, FIG. 4 illustrates a pocket 204 disposed on the plurality of strips 202 of the first torso panel 200 for mounting various accessories. The pair of shoulder straps 208 is disposed on shoulder portions of the first torso panel 200. The shoulder pad 206 is configured to cover a substantial portion of the shoulder strap 208. The shoulder pad 206 is configured to provide cushioning to shoulder portions of the user. As depicted in FIG. 2, the flap 210 is configured to cover a portion of the quick release mechanism 600. The flap 210 may also include the plurality of strips 202. The bullet resistance armor 212 may be disposed on the first torso panel 200. In one embodiment of the present invention, as shown in FIG. 5B the bullet resistant armor 212 may be disposed on an inner surface of the first torso panel 200. In another embodiment of the present invention the bullet resistant armor 212 may be disposed on an outer surface of the first torso panel 200. The first torso panel 200 and the second torso panel 300 are configured to cover the torso portion of the user.

Figure 6:
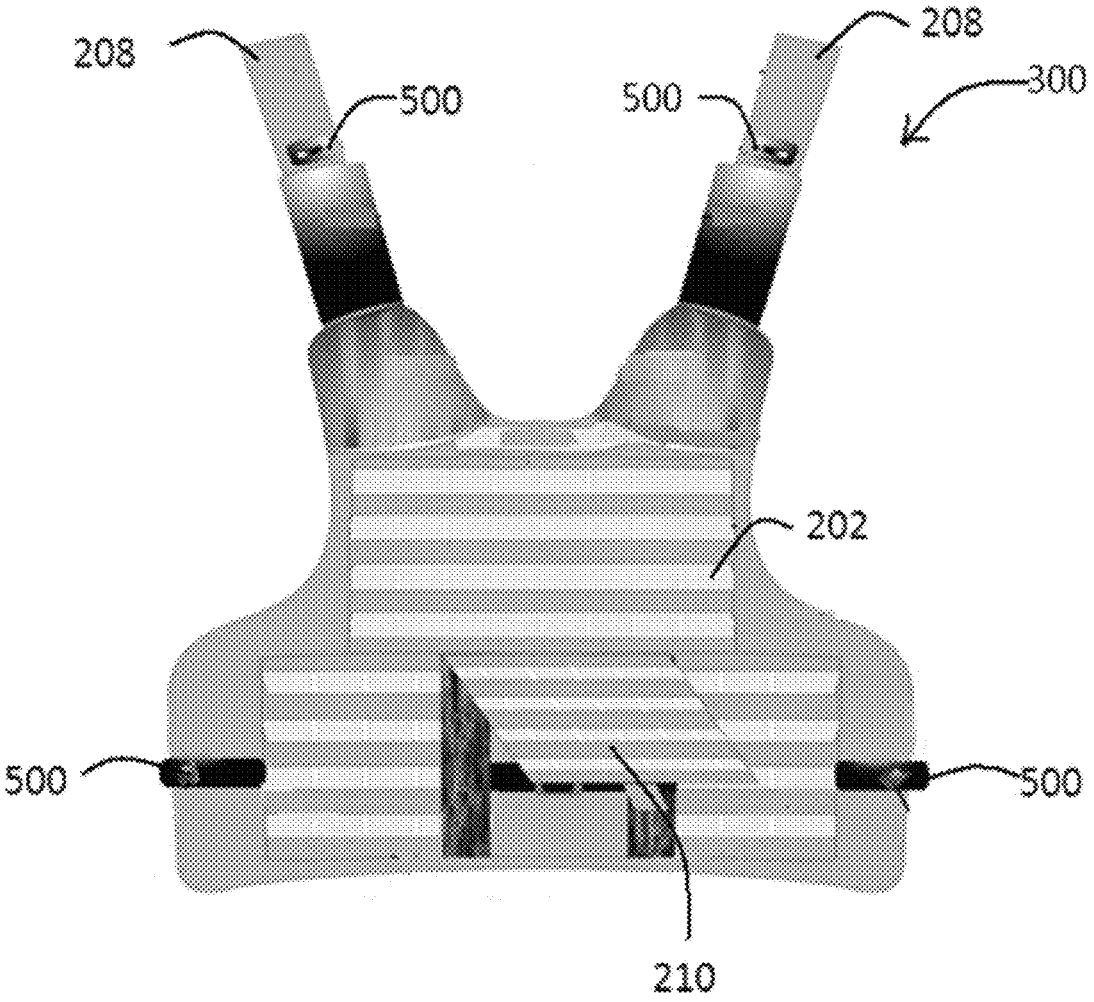
FIG. 6 illustrates a perspective view of an outer surface of the second torso panel of FIG. 1, according to an embodiment of the present invention.
Figure 7A:
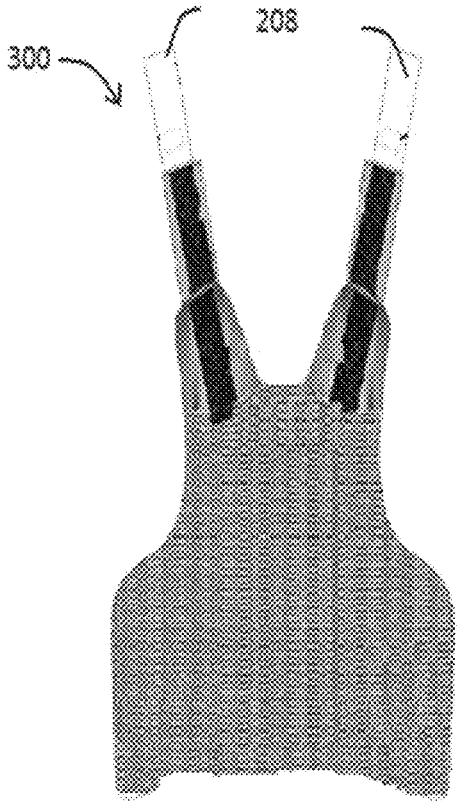
FIG. 7A illustrates a perspective view of an inner surface of a second torso panel, according to an embodiment of the present invention.
Figure 7B:
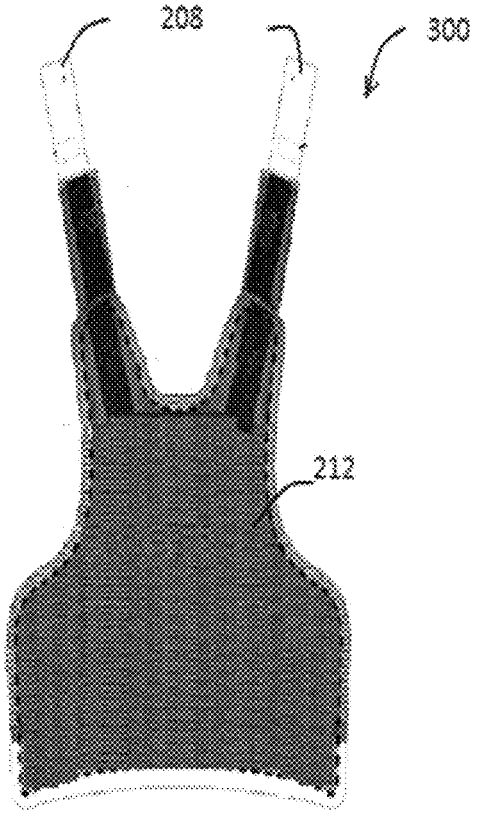
FIG. 7B illustrates a perspective view of an inner surface of a second torso panel with a bullet resistant armor, according to an embodiment of the present invention.

With reference to FIG. 6, FIG. 7*a* and FIG. 7*b*, the second torso panel 300 configured to cover either a rear side or a front side of a torso portion of a user, is shown. In one embodiment of the present invention the second torso panel 300 may cover the rear side of the torso portion of the user. In another embodiment of the present invention the second torso panel 300 may cover the front side of the torso portion of the user. In one embodiment of the present invention the second torso panel 300 may accompany a plurality of strips 202, a pair of shoulder straps 208, a flap 210 and a bullet resistance armor 212.

The plurality of strips 202 may be disposed both vertically and horizontally on the second torso panel 300 to accommodate various accessories such as pouches, magazines, water carrier, medical kit, small portable walkie-talkie sets and other similar equipments which can be positioned or fixed as per the convenience of a wearer. The construction of the plurality of strips 202 permits positioning of accessory pouch etc. at different locations on the second torso panel 300. More specifically, FIG. 4 illustrates the pocket 204 disposed on the plurality of strips 202 of the second torso panel 300 for mounting various accessories. The pair of shoulder straps 208 may be disposed on shoulder portions of the second torso panel 300. The flap 210 is configured to pivotally cover a lower portion of the second torso panel 300. The flap 210 may also include the plurality of strips 202. The bullet resistance armor 212 may be disposed on the second torso panel 200. In one embodiment of the present invention, as shown in FIG. 7B the bullet resistant armor 212 may be disposed on an inner surface of the second torso panel 300 of the quickly releasable vest 100. In another embodiment of the present invention the bullet resistant armor 212 may be disposed on an outer surface of the second torso panel 300 of the quickly releasable vest 100.

Figure 8:
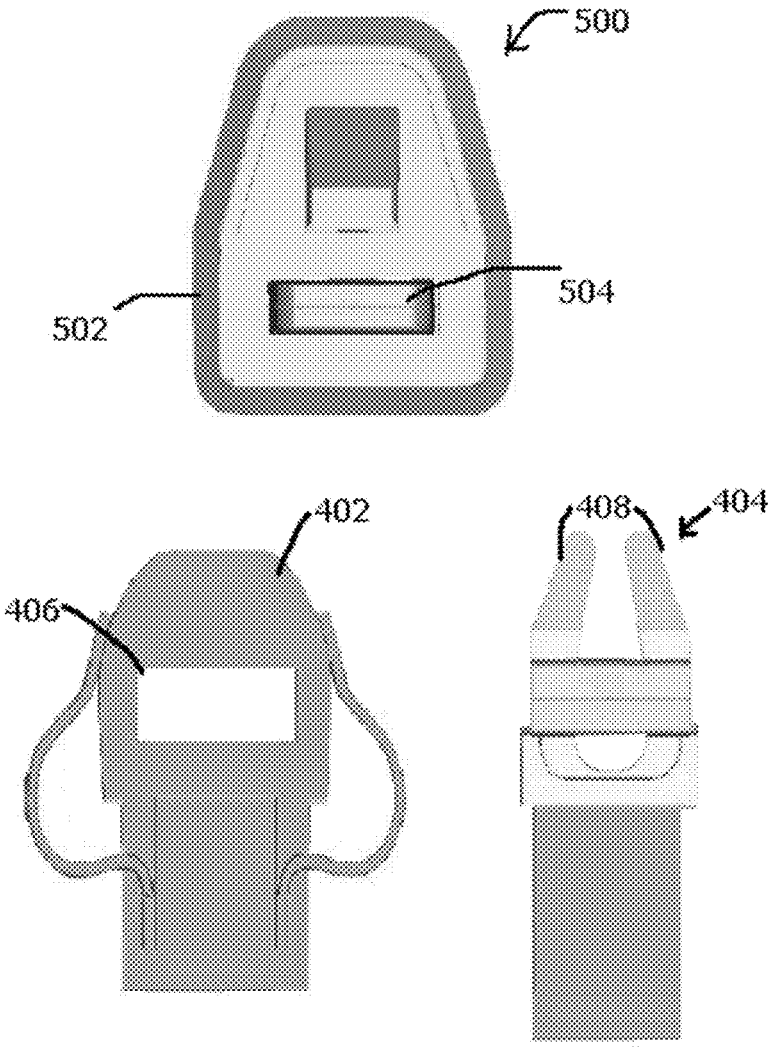
FIG. 8 illustrates a perspective view of a plug member and a socket member separately, according to an embodiment of the present invention.
Figure 9:
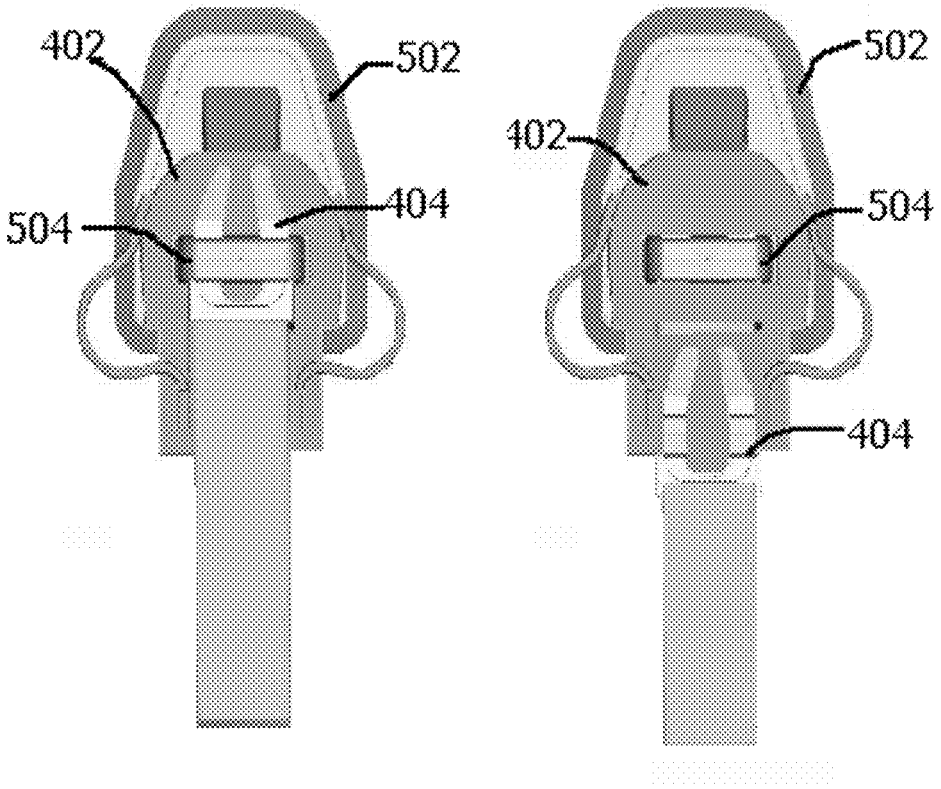
FIG. 9 illustrates a perspective view of a plug member and a socket member in fastened position and in released position, according to an embodiment of the present invention.
Figure 10:
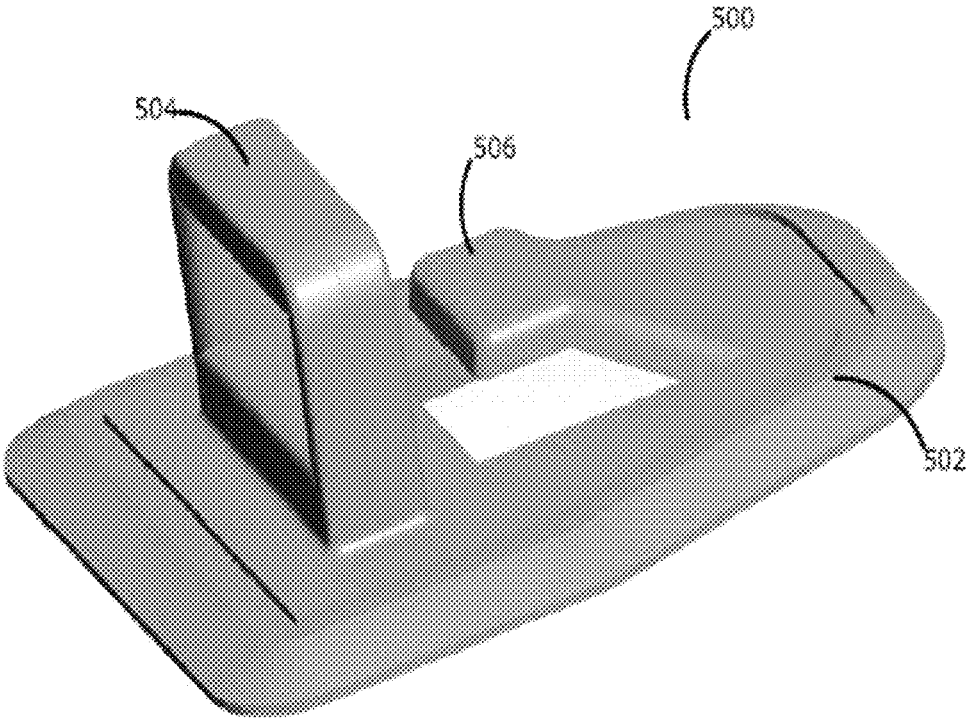
FIG. 10 illustrates a perspective view of a socket member comprising a spring member, according to an embodiment of the present invention.
Figure 11:
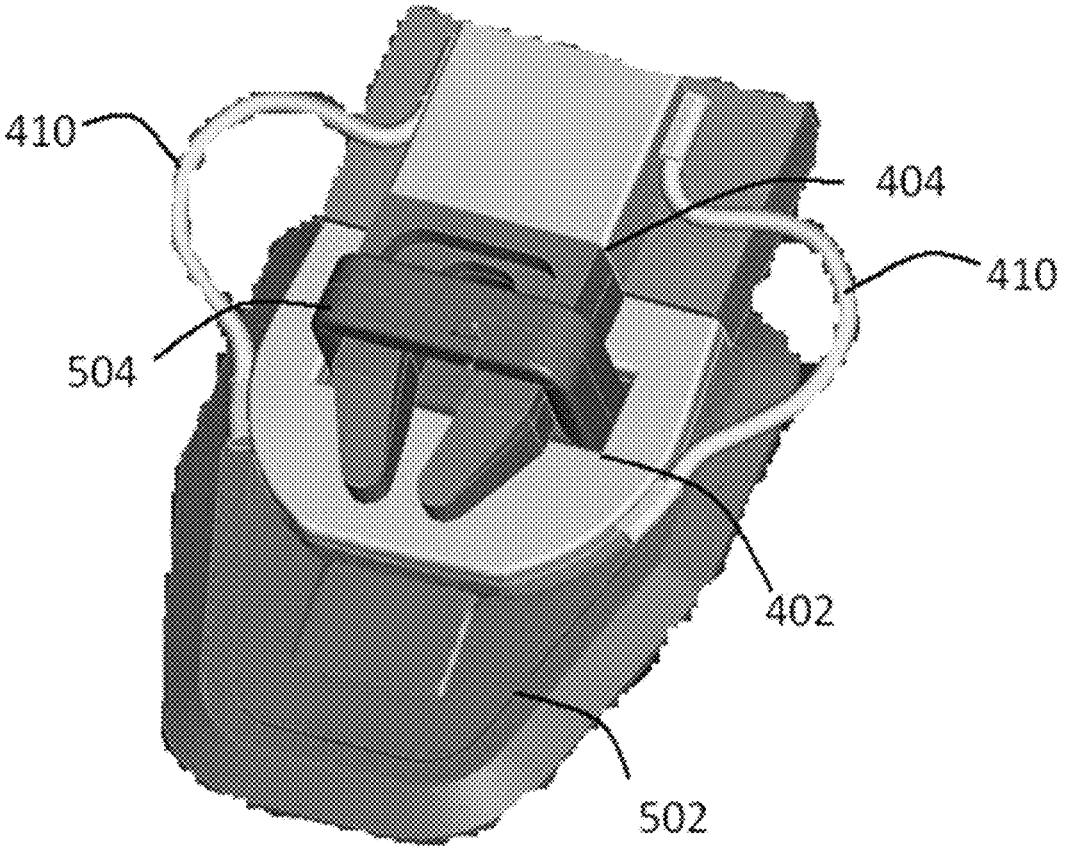
FIG. 11 illustrates a perspective view of a plug member and a socket member in fastened position, wherein the plug member includes a pair of connecting wires, according to an embodiment of the present invention.

As shown in FIG. 8, FIG. 9 and FIG. 11 the quickly releasable vest 100 further includes the plurality of plug members 400. The plurality of plug members 400 is disposed on the first torso panel 200. In one embodiment of the present invention, the plurality of plug members 400 is disposed on the shoulder strap 208 of the first torso panel 200. In one embodiment of the present invention each of the plurality of plug members 400 includes an eye hook 402 and a tongue 404. The eye hook 402 includes an eye opening 406. In one embodiment of the present invention the eye opening 406 is rectangular in configuration. The tongue 404 includes a pair of engaging legs 408. The engaging legs 408 are curved inwardly towards each other. In another embodiment of the present invention each of the plurality of plug members 400 further includes a pair of connecting wires 410 (shown in FIG. 11)). Each of the pair of connecting wires 410 is configured to connect a side portion of the eye hook 402 to a side portion of the tongue 404. The tongue 404 is configured to be received in one of the plurality of socket members 500 disposed on the second torso panel 300. Although in the present invention each of the plurality of plug members 400 have been described with respect to particular embodiments but they are not intended to be exhaustive or to limit the present invention to the precise forms disclosed. Each of the plurality of plug members 400 is configured to detachably couple to one of the plurality of socket members 500 disposed on the second torso panel 300.

Referring to FIG. 8, FIG. 9 FIG. 10 and FIG. 11 the plurality of socket members 500 configured to be detachably couple to the plurality of plug members 400, is shown. The plurality of socket members 500 is disposed on the second torso panel 300. In one embodiment of the present invention, the plurality of socket members 500 is disposed on the shoulder strap 208 of the second torso panel 300. In one embodiment of the present invention the each of the plurality of socket members 500 includes a base plate 502 and a rigid head 504. The rigid head 504 is disposed perpendicularly to the base plate 502. The rigid head 504 is configured to hook the eye hook 402. Further, the rigid head 504 is also configured to receive the tongue 404. In another embodiment of the present invention the each of the plurality of socket members 500 further includes a spring member 506. The spring member 506 is disposed on the base plate 502 of the each of the plurality of socket members 500. In one embodiment of the present invention the spring member 506 is hingedly connected to the base plate 502 of the socket members 500. The spring member 506 is configured to force out the eye hook 402 from the rigid head 504 when the tongue 404 is pulled out of the rigid head 504. The tongue 404 may be pulled out of the rigid head 504 by means of the quick release mechanism 600.

Figure 12:
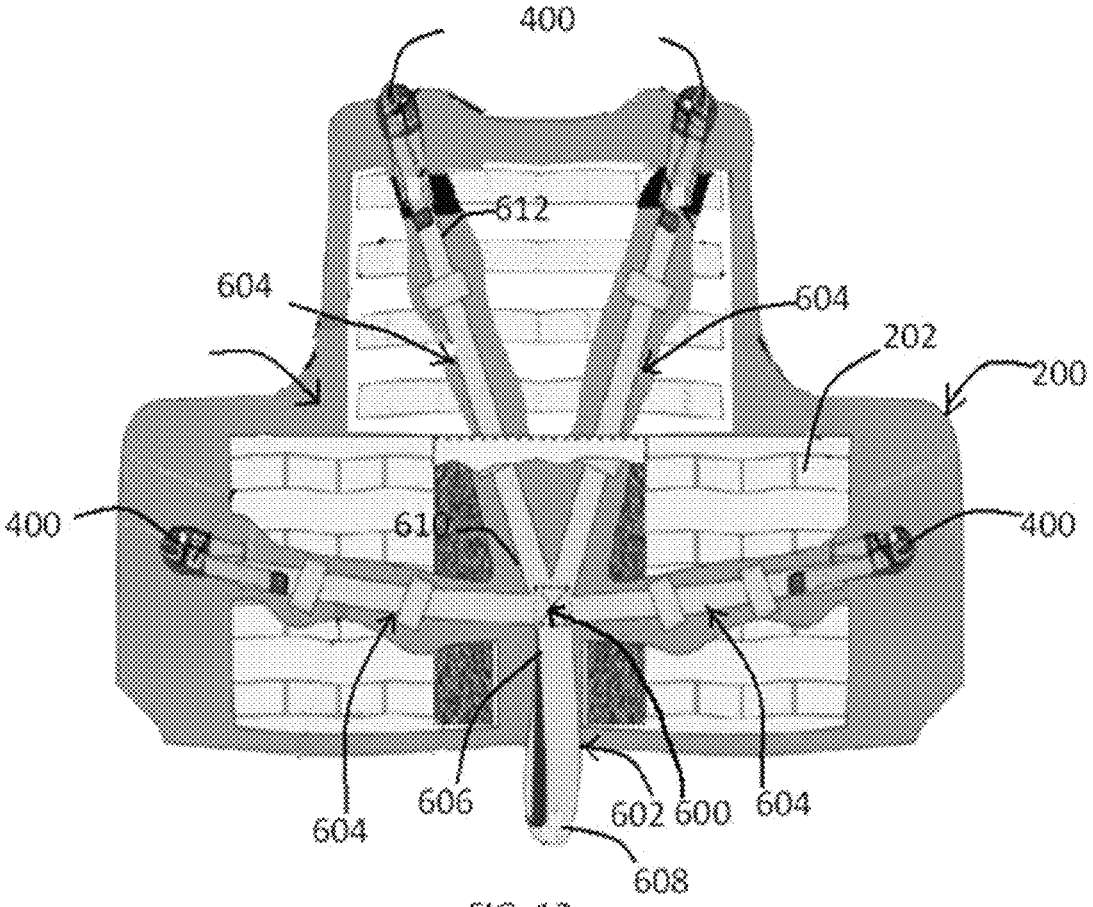
FIG. 12 illustrates a perspective view of a quick release mechanism disposed on the first torso panel, according to an embodiment of the present invention.
Figure 13:
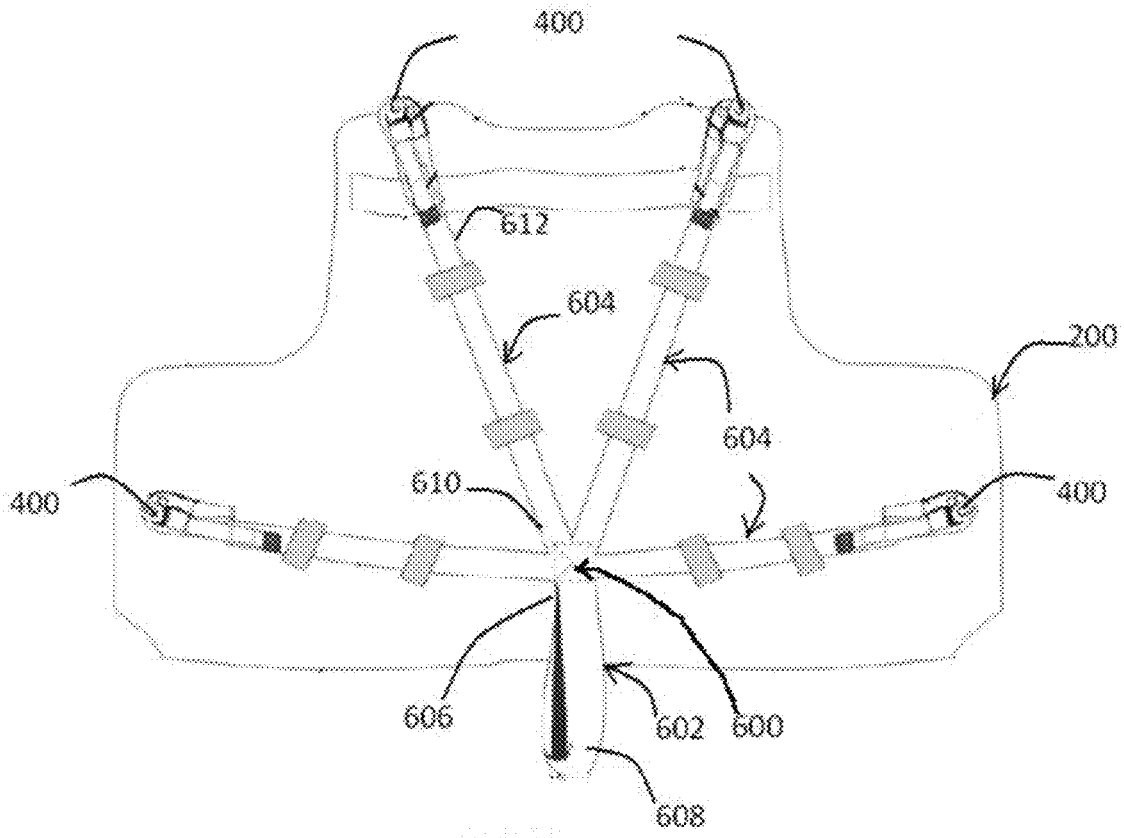
FIG. 13 illustrates a perspective view of a quick release mechanism disposed on the first torso panel, according to an embodiment of the present invention.

Now referring to FIG. 12 and FIG. 13, the quick release mechanism 600 disposed on the first torso panel 200, is shown. The quick release mechanism 600 includes a pull cord 602 and a plurality of connecting tapes 604. The pull cord 602 has a proximal end portion 606 and a distal end portion 608. Each of the plurality of connecting tapes 604 includes a first end portion 610 and a second end portion 612. The first end portion 610 of the each of the plurality of connecting tapes 604 is coupled to the proximal end portion 606 of the pull cord 602 and the second end portion 612 of the each of the plurality of connecting tapes 604 is coupled to the one of the plurality of plug members 400. More specifically, the each of the plurality of connecting tapes 604 is coupled to one of the tongue 404 of the plurality of plug members 400. Further, the distal end portion 608 of the pull cord 602 may be coupled to a grip (not shown). In one embodiment of the present invention, the pull cord 602 of the quick release mechanism 600 is positioned at the lower portion of the first torso panel 200 for easy and quick access by the user for the purpose of quick release of the first torso panel 200 from the second torso panel 300. In one embodiment of the present invention, the pull cord 602 of the quick release mechanism 600 may be covered by the flap 210 of the first torso panel 200. The pull cord 602 is configured to separate the first torso panel 200 and the second torso panel 300 from each other, when the pull cord 602 is pulled downwards.

In use, while dressing in the quickly releasable vest 100, the wearer has to place the first torso panel 200 over the second torso panel 300 so that the inner faces of both the first torso panel 200 and the second torso panel 300 are placed one over the other and fully aligned with each other. Thereafter the eye hook 402 of the plurality of plug members is hooked to the rigid head 504 of the plurality of socket members 500, and then the tongue 404 of the plurality of plug members is inserted into the rigid head 504 of the plurality of socket members 500 over the eye hook 402. In one embodiment of the present invention the shoulder straps 208 of the second torso panel 300 are inserted partially in a slot (not shown) disposed on the first torso panel 200 so that the shoulder strap 208 of the first torso panel 200 may be placed over the shoulder strap 208 of the second torso panel 300. Thereafter the eye hook 402 of the plurality of plug members is hooked to the rigid head 504 of the plurality of socket members 500, and then the tongue 404 of the plurality of plug members 400 is inserted into the rigid head 504 of the plurality of socket members 500 over the eye hook 402. This process is to be repeated mutatis mutandis at all the points where the first torso panel 200 is releasably attached with the second torso panel 300.

Similarly, while separating the quickly releasable vest 100 from the torso portion of the user, the user has to drag the pull cord 602 downwards by applying downward pressure on the connecting tapes 604. Accordingly, in one embodiment of the present invention, the connecting tapes 604 pulls the tongue 404 of the plurality of plug members 400 out of the rigid head 504 and while being pulled out, the tongue 404 also pulls out the eye hook 402 by means of the pair of connecting wires 410. In another embodiment of the present invention, the connecting tapes 604 pull the tongue 404 of the plurality of plug members 400 out of the rigid head 504. As, the tongue 404 is pulled out of the rigid head 504, the spring member 506 forces the eye hook 402 to be unhooked from the rigid head 504.

Figure 14:
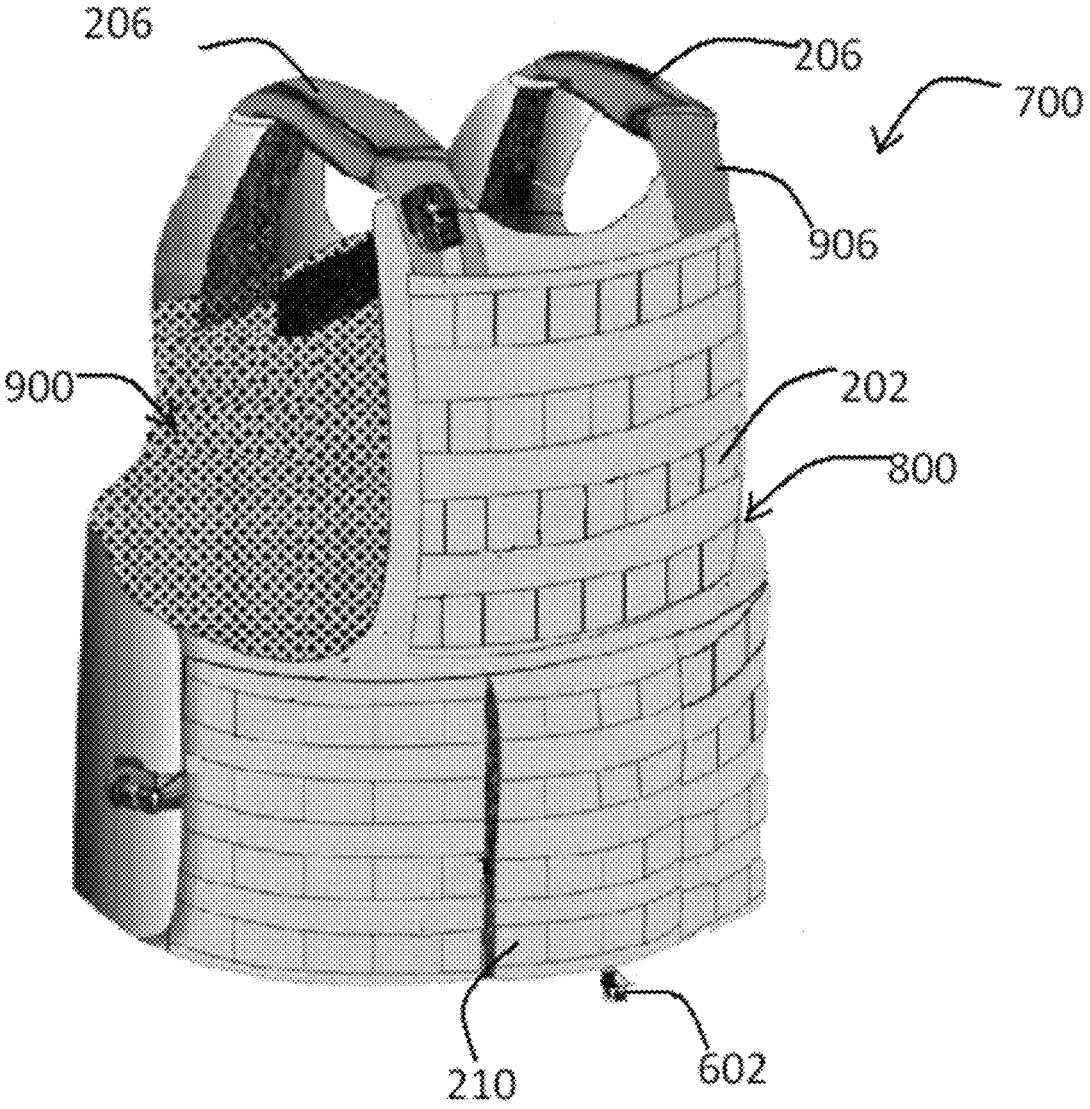
FIG. 14 illustrates a perspective view of a quickly releasable vest including a first torso panel and a second torso panels held together by means of a plurality of plug members and a plurality of socket members, according to an another embodiment of the present invention.

FIG. 14 to FIG. 17 illustrates another embodiment of a quickly releasable vest in accordance with the present invention. More specifically, FIG. 14 illustrates the quickly releasable vest 700 configured to cover a torso portion of a user. The quickly releasable vest 700 includes a first torso panel 800, a second torso panel 900, a plurality of plug members 1000, a plurality of socket members 1100 and a quick release mechanism 1200.

Figure 15:
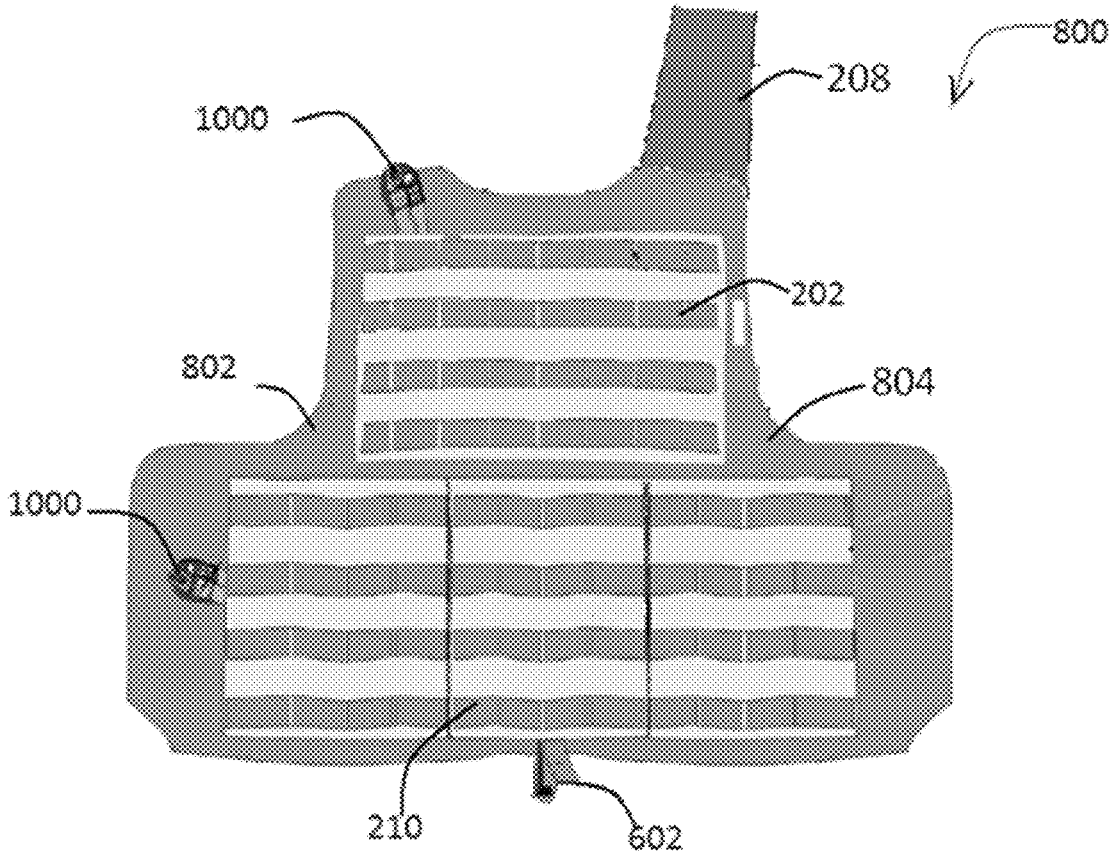
FIG. 15 illustrates a perspective view of an outer surface of the first torso panel of FIG. 14, according to an another embodiment of the present invention.

Now referring to FIG. 15, the first torso panel 800 configured to cover either a front side or a rear side of a torso portion of a user, is shown. In one embodiment of the present invention the first torso panel 800 may cover the front side of the torso portion of the user. In another embodiment of the present invention the first torso panel 800 may cover the rear side of the torso portion of the user. The first torso panel 800 includes a first side portion 802 and a second side portion 804. The first torso panel 800 may be made by over lined layers of sewn fabric. In one embodiment of the present invention the first torso panel 800 may accompany the plurality of strips 202, the pair of shoulder pads 206, the pair of shoulder straps 208, the flap 210 and the bullet resistance armor 212. The plurality of strips 202, the pair of shoulder pads 206, the pair of shoulder straps 208, the flap 210 and the bullet resistance armor 212 are configured and disposed on the first torso panel 800 similarly as they are configured and disposed on the first torso panel 200. The first torso panel 800 and the second torso panel 900 are configured to cover the torso portion of the user.

Figure 16:
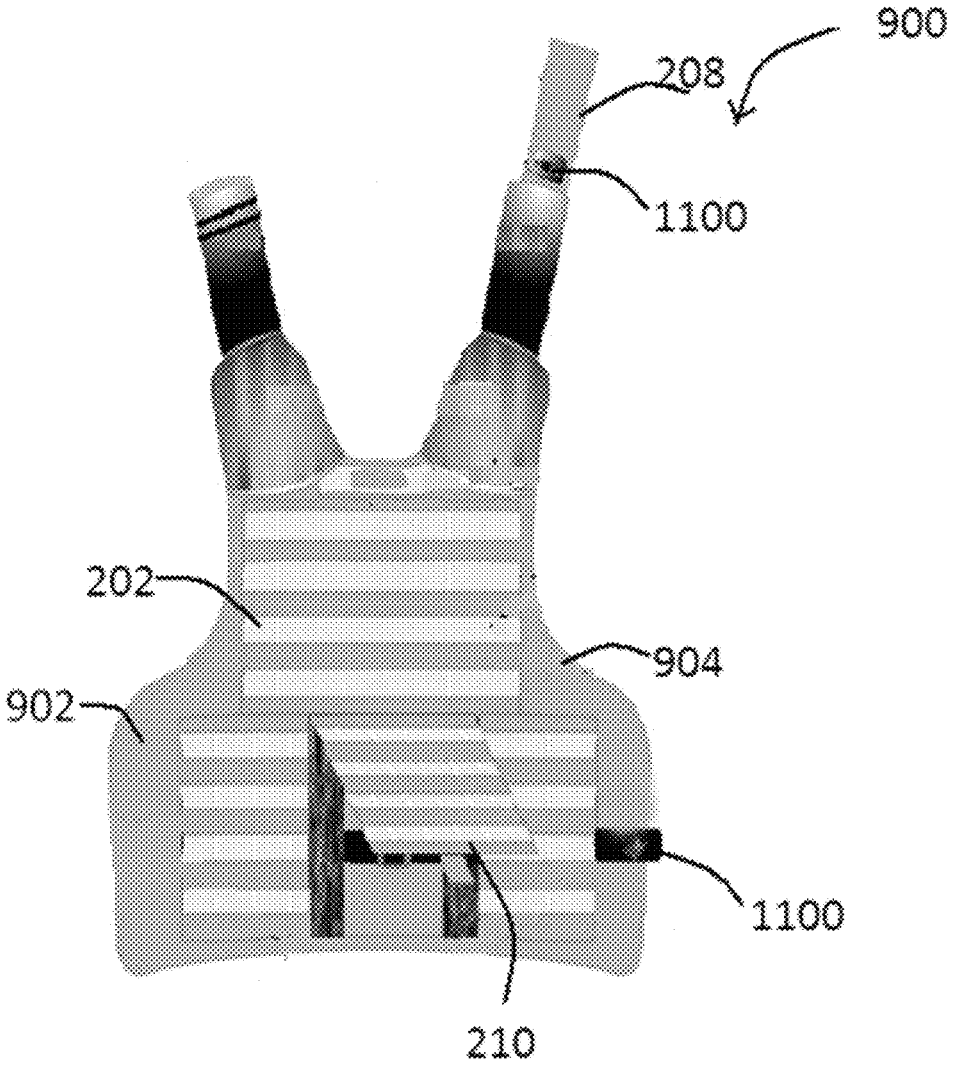
FIG. 16 illustrates a perspective view of an outer surface of the second torso panel of FIG. 14, according to another embodiment of the present invention.
Figure 17:
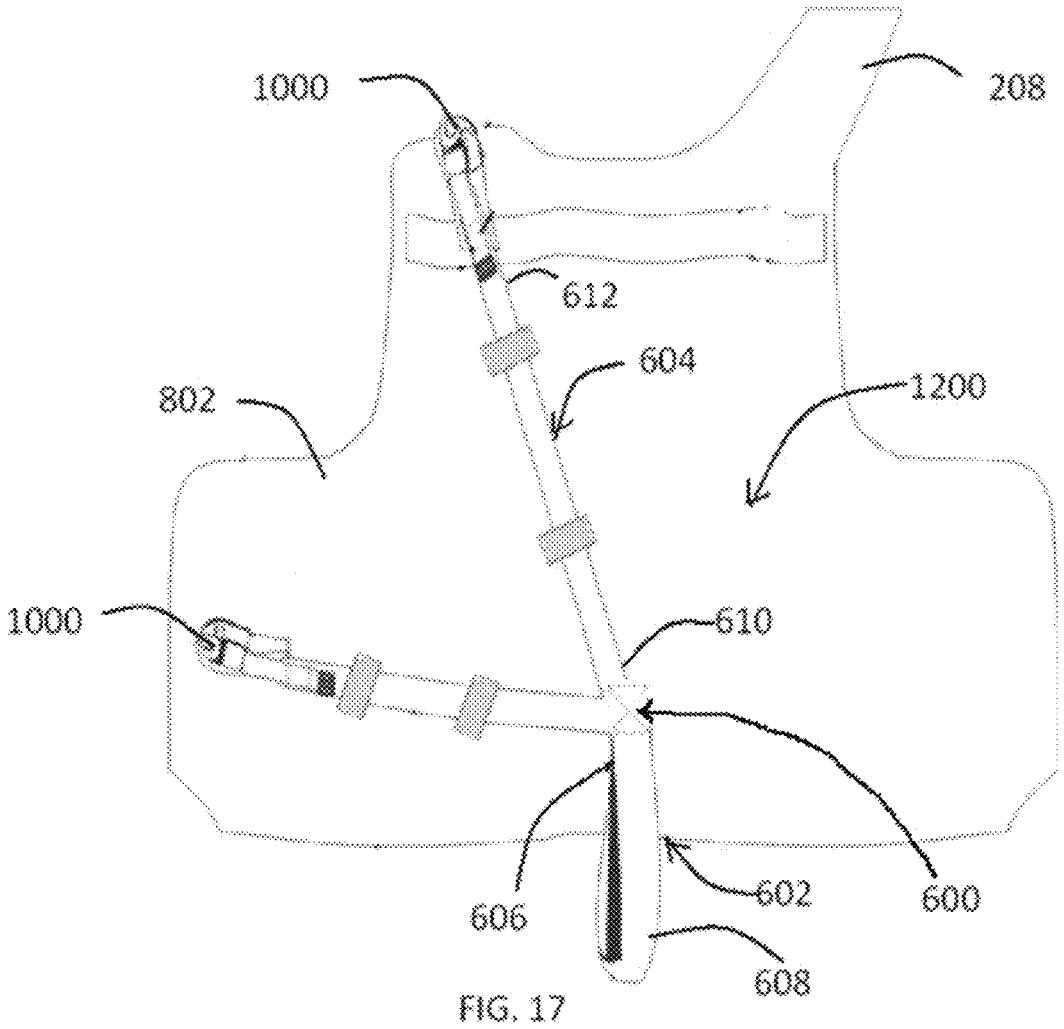
FIG. 17 illustrates a perspective view of a quick release mechanism disposed on the first torso panel of FIG. 15, according to an another embodiment of the present invention.

As shown in FIG. 16, the second torso panel 900 is configured to cover either a rear side or a front side of a torso portion of a user. In one embodiment of the present invention the second torso panel 900 may cover the rear side of the torso portion of the user. In another embodiment of the present invention the second torso panel 900 may cover the front side of the torso portion of the user. The second torso panel 900 includes a first side portion 902 and a second side portion 904. The first side portion 902 of the second torso panel 900 is releasably coupled to the second side portion 804 of the first torso panel 800. In one embodiment of the present invention the first side portion 902 of the second torso panel 900 is releasably coupled to the second side portion 804 of the first torso panel 800 by means of an adhesive tape 906. In another embodiment of the present invention, the first side portion 902 of the second torso panel 900 is permanently coupled to the second side portion 804 of the first torso panel 800. The first side portion 902 of the second torso panel 900 may be permanently coupled to the second side portion 804 of the first torso panel 800 by means of stitching or any other means known in the art. In one embodiment of the present invention the second torso panel 900 may accompany the plurality of strips 202, the pair of shoulder straps 208, the flap 210 and the bullet resistance armor 212. The plurality of strips 202, the pair of shoulder straps 208, the flap 210 and the bullet resistance armor 212 are configured and disposed on the second torso panel 900 similarly as they are configured and disposed on the second torso panel 300 of the quickly releasable vest 100.

The quickly releasable vest 700 further includes the plurality of plug members 1000. The plurality of plug members 1000 is similar to the plurality of plug members 400 explained above in the first embodiment of the present embodiment. The plurality of plug members 1000 is disposed on the first side portion 802 of the first torso panel 800. In one embodiment of the present invention, the first side portion 802 of the first torso panel 800 is on the left hand side of a right handed user. In another embodiment of the present invention, the first side portion 802 of the first torso panel 800 is on the right hand side of a left handed user. Each of the plurality of plug members 1000 is configured to be detachably couple to one of the plurality of socket members 1100. The plurality of socket members 1100 are similar to the plurality of socket members 500 explained above in the first embodiment of the present invention. The plurality of socket members 1100 is disposed on the second side portion 904 of the second torso panel 900. The first side portion 802 of the first torso panel 800 may be separated from the second side portion 904 of the second torso panel 900 by means of the quick release mechanism 1200 (shown in FIG. 17). The quick release mechanism 1200 is also similar to the quick release mechanism 600 explained in the first embodiment of the present invention. The quick release mechanism 1200 is disposed on the first torso panel 800.

Figure 18:
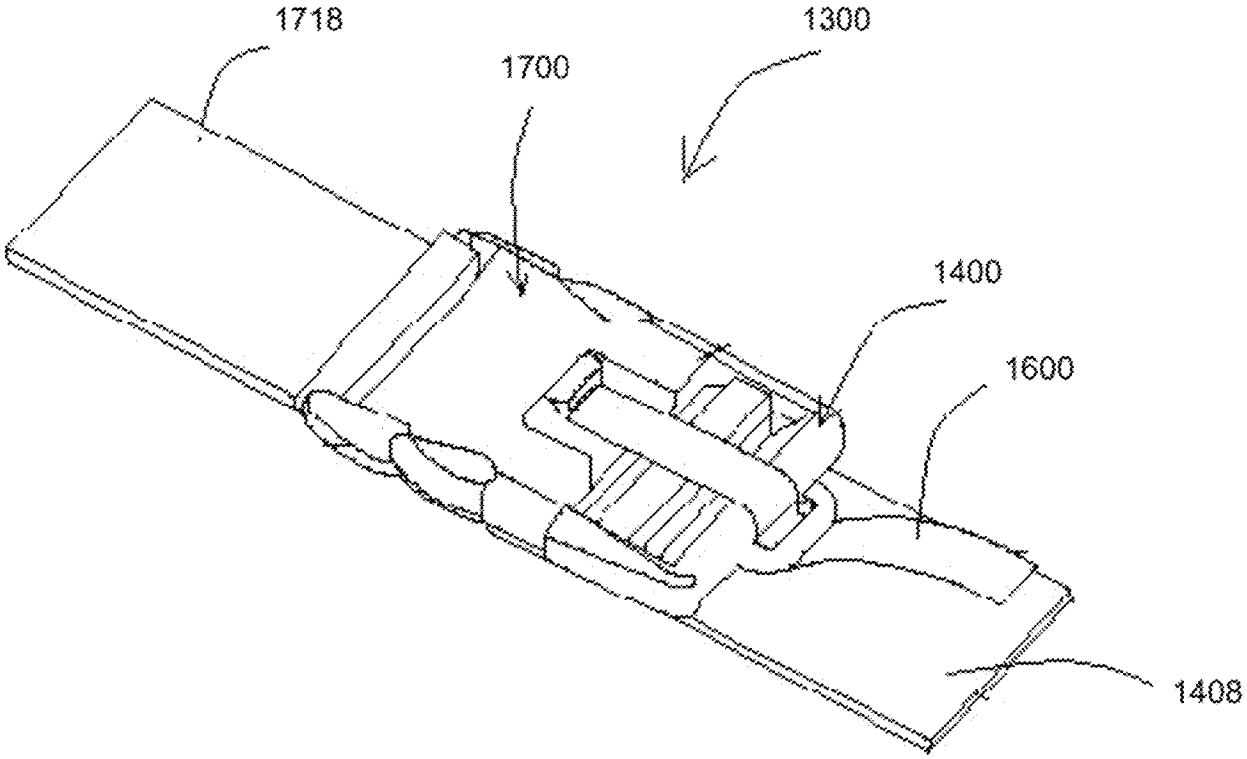
FIG. 18 illustrates a perspective view of a self locking buckle assembly in assembled position, according to an embodiment of the present invention(s)
Figure 19:
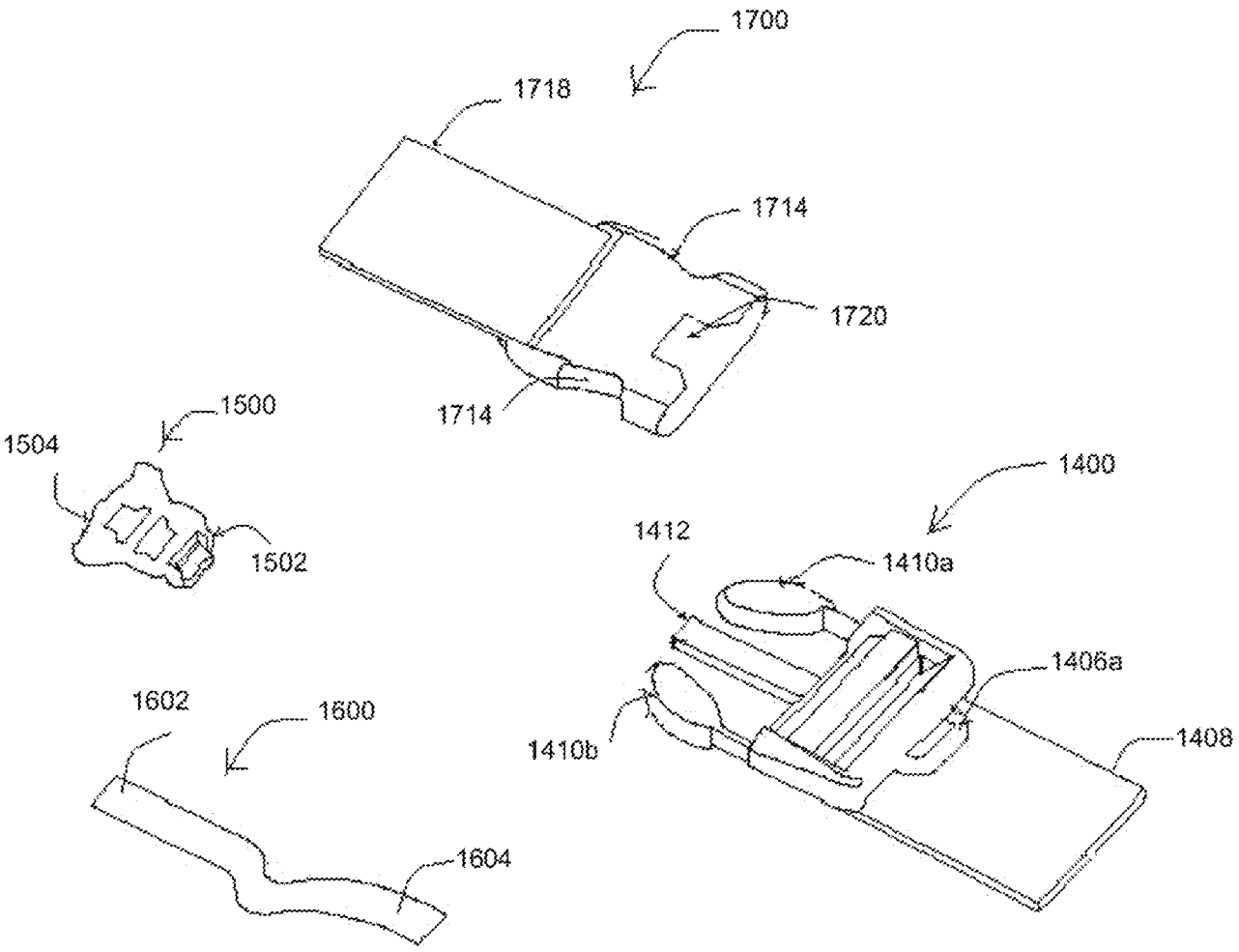
FIG. 19 illustrates a perspective view of the self locking buckle assembly of FIG. 1 in disassembled position, according to an embodiment of the present invention(s)
Figure 21A:
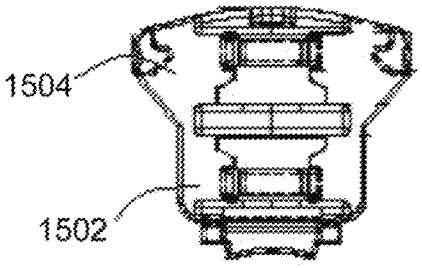
FIG. 21*a* illustrates a front view of a ferrule in one orientation thereof, according to an embodiment of the present invention(s)
Figure 21E:
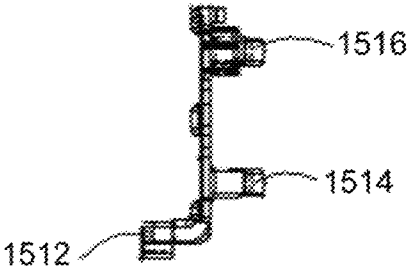
FIG. 21*e* illustrates a side view of the ferrule, according to an embodiment of the present invention(s)
Figure 21F:
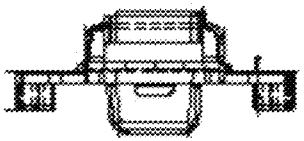
FIG. 21*f* illustrates an end view of the ferrule, according to an embodiment of the present invention(s)
Figure 21B:
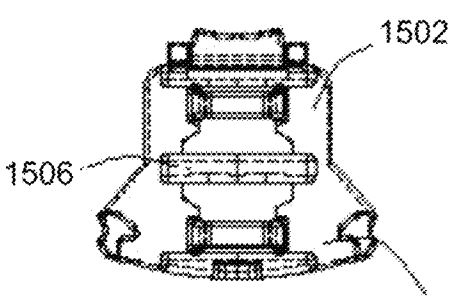
FIG. 21*b* illustrates a front view of a ferrule in another orientation thereof, according to an embodiment of the present invention(s)
Figure 21C:
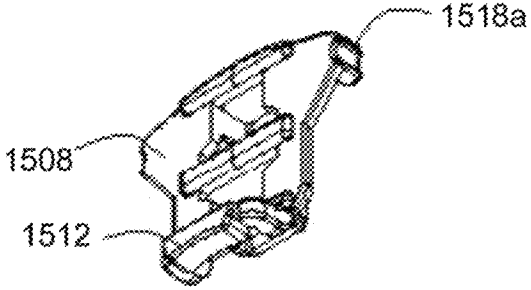
FIG. 21*c* illustrates one side top view of a ferrule, according to an embodiment of the present invention(s)
Figure 21D:
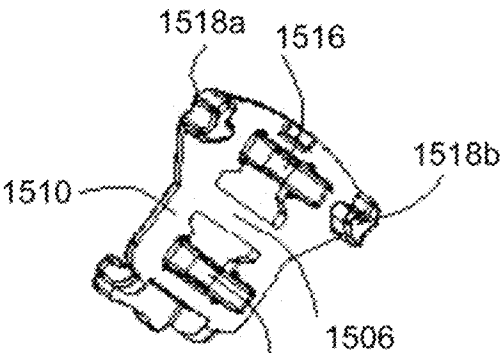
FIG. 21*d* illustrates another side top view of the ferrule, according to an embodiment of the present invention(s)
Figure 22D:
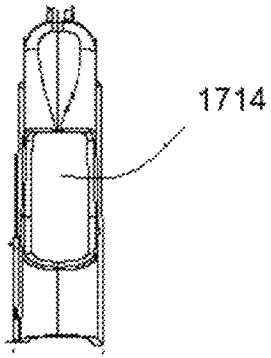
FIG. 22*d* illustrates a side view of the socket assembly, according to an embodiment of the present invention(s)
Figure 22B:
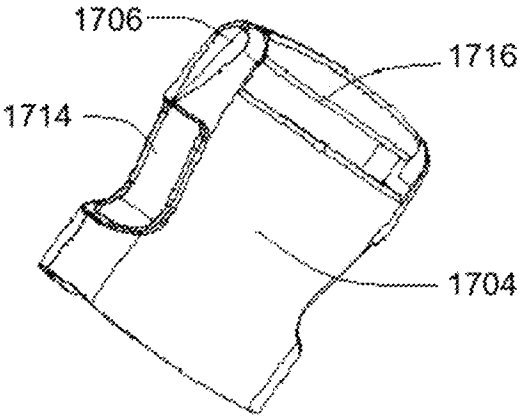
FIG. 22*b* illustrates a perspective view of the socket assembly depicting another face thereof, according to an embodiment of the present invention(s)
Figure 22C:
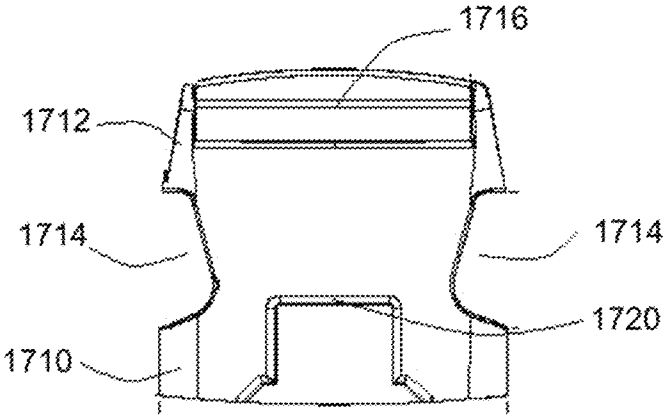
FIG. 22*c* illustrates a front view of the socket assembly depicting another face thereof, according to an embodiment of the present invention(s)
Figure 22A:
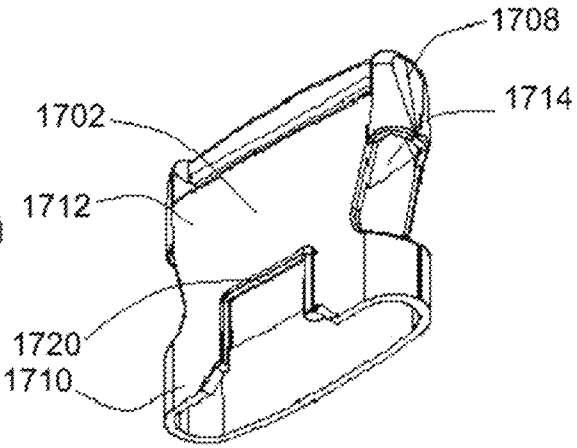
FIG. 22*a* illustrates a perspective view of a socket assembly depicting one face thereof, according to an embodiment of the present invention(s)
Figure 22E:
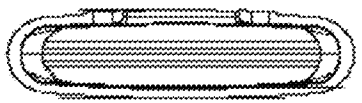
FIG. 22*e* illustrates an end side view of the socket assembly, according to an embodiment of the present invention(s)

Referring to FIG. 18 and FIG. 19, a self locking buckle assembly 1300 configured to removably connect two parts of any device together, is shown. The self locking buckle assembly 1300 includes a wedge fork 1400, a ferrule 1500, an elongated strip 1600 and a socket assembly 1700.

Now referring to FIG. 18, FIG. 19 and FIGS. 20*a* to 20*e*, the wedge fork 1400 may include a base portion 1402 and a body portion 1404. The base portion 1402 includes a securing means 1406*a* and a webbing guide 1406*b*. In one embodiment, the securing means 1406*a* is an eye hook 1406*a*. However, the present invention is not limited to any particular form of the securing means 1406*a* used. The base portion 1402 is configured to secure a webbing 1408 to the webbing guide 1406*b*. The webbing 1408 may be configured to be secured to one of the two parts to be secured together. The webbing 1408 may be a load bearing webbing. The body portion 1404 includes a pair of legs, such as a leg 1410*a* and a leg 1410*b* (hereinafter collectively referred to as "pair of legs 1410") and a ferrule guide member 1412. Each of the pair of legs 1410 is configured to be flexible in nature. More specifically, each of the pair of legs 1410 and the ferrule guide member 1412 is extending from the base portion 1402. Each of the pair of legs 1410 includes a leg base portion 1414 and a prong 1416.

The prong 1416 includes an operative upper face 1418. The upper face 1418 of the prong 1416 includes a notch portion 1420 configured therein. In one embodiment of the present invention, the notch portion 1420 is configured to be arcuate in shape. Further, in one embodiment of the present invention, the notch portion 1420 includes a proximal end portion 1422 and a distal end portion 1424. In one embodiment of the present invention, the distal end portion 1424 of the notch portion 1420 may include a cut-out portion (not shown) adapted to facilitate locking of the ferrule 1500 thereto. Further, the ferrule guide member 1412 includes an elongated central notch portion 1414*a*. The ferrule guide member 1412 is configured to act as a guide for the ferrule 1500.

Now referring to FIG. 18, FIG. 19 and FIGS. 21*a* to 21*f*, the ferrule 1500 includes a narrower end portion 1502, a broader end portion 1504, a tape guide member 1506, an operative front face 1508 and an operative back face 1510. The narrower end portion 1502 includes a first eye hook 1512 and a second eye hook 1514. The first eye hook 1512 is extending perpendicularly from the operative front face 1508 of the ferrule 1500 and the second eye hook 1514 is extending perpendicularly from the operative back face 1510 of the ferrule 1500. The broader end portion 1504 is configured to be extending and expanding from the narrower end portion 1502. The broader end portion 1504 includes a third eye hook 1516 and a pair of slide members, such as a slide member 1518*a* and a slide member 1518*b* (hereinafter collectively referred to as "pair of slide members 1518"). In one embodiment of the present invention, the broader end portion 1504 of the ferrule 1500 may include a locking means on either side thereof corresponding to the cut-out portion of the distal end portion 1424 of the notch portion 1420 of the prong 1416 for facilitating removable locking with the prong 1416. The third eye hook 1516 is configured to be extending perpendicularly from the operative back face 1510 of the ferrule 1500. Similarly, each of the pair of slide members 1518 is extending perpendicularly from end portions of the broader end portion 1504. More specifically, each of the pair of slide members 1518 is extending perpendicularly from the operative back face 1510. The ferrule 1500 is configured to be slidingly disposed on the ferrule guide member 1412. More specifically, the ferrule 1500 is slidingly disposed on the ferrule guide member 1412 by means of the second eye hook 1514 and the third eye hook 1516. Further, the pair of slide members 1518 is configured to be slidingly disposed in the notch portion 1420 of the prong 1416. More specifically, the pair of slide members 1518 is configured to be slidingly moved along the notch portion 1420 of the prong 1416 in a way such that the movement of the pair of slide members 1518 enables movement of the prong 1416 of the pair of legs 1410. Further, movement of the ferrule 1500, and accordingly movement of the pair of slide members 1518 towards the leg base portion 1414 enables movement of the prong 1416 of the pair of legs 1410 towards each other and movement of the ferrule, and accordingly movement of the pair of slide members 1518 away from the leg base portion 1414 enables movement of the prong 1416 of the pair of legs 1410 away from each other. Further, the ferrule 1500 is configured to be secured to the elongated strip 1600.

Now referring back to FIG. 19, the elongated strip 1600 includes a proximal end portion 1602 and a distal end portion 1604. The proximal end portion 1602 is connected to the tape guide member 1506 of the ferrule 1500. The distal end portion 1604 is firstly passed through the first eye hook 1512 of the ferrule 1500 and then passed through the eye hook 1406*a* of the wedge fork 1400. The distal end portion 1604 of the elongated strip 1600 may be used for the movement of the ferrule 1500.

Now referring to FIG. 18, FIG. 19 and FIG. 22*a* to FIG. 22*e*, the socket member 1700 includes an upper portion 1702, a lower portion 1704, a first side portion 1706, a second side portion 1708, a first end portion 1710 and a second end portion 1712. The upper portion 1702, the lower portion 1704, the first side portion 1706 and the second side portion 1708 are configured to define a hollow portion there between. The first side portion 1706 and the second side portion 1708 include an opening 1714 configured thereon. The opening 1714 is configured to retain and lock the prong 1416 of the each of the pair of legs 1410 therein. The socket member 1700 includes an eye hook 1716 configured on the first end portion 1710. The eye hook 1716 is configured to secure a webbing 1718 thereto. Further the webbing 1718 is configured to be secure to one of the two items secured to each other. The webbing 1718 may be a load bearing webbing. The upper portion 1702 includes a rectangular cut portion 1720 configured thereon. The rectangular cut portion 1720 is configured to be accommodating a portion of the ferrule 1500.

Figure 23B:
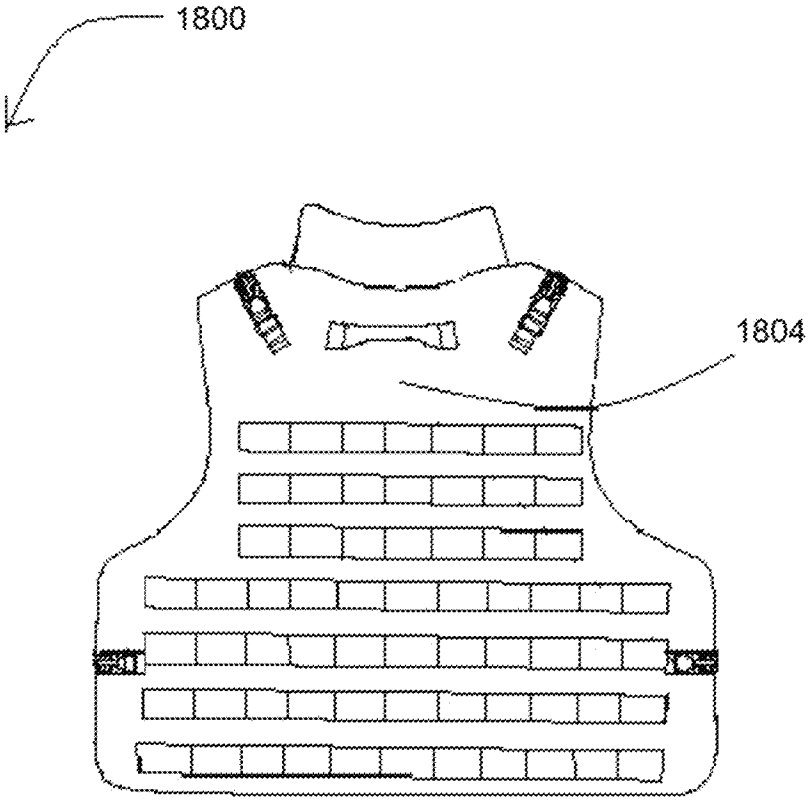
FIG. 23*b* illustrates a back view of the quickly releasable vest depicting used position of the self locking buckle assembly, according to an embodiment of the present invention(s).
Figure 23A:
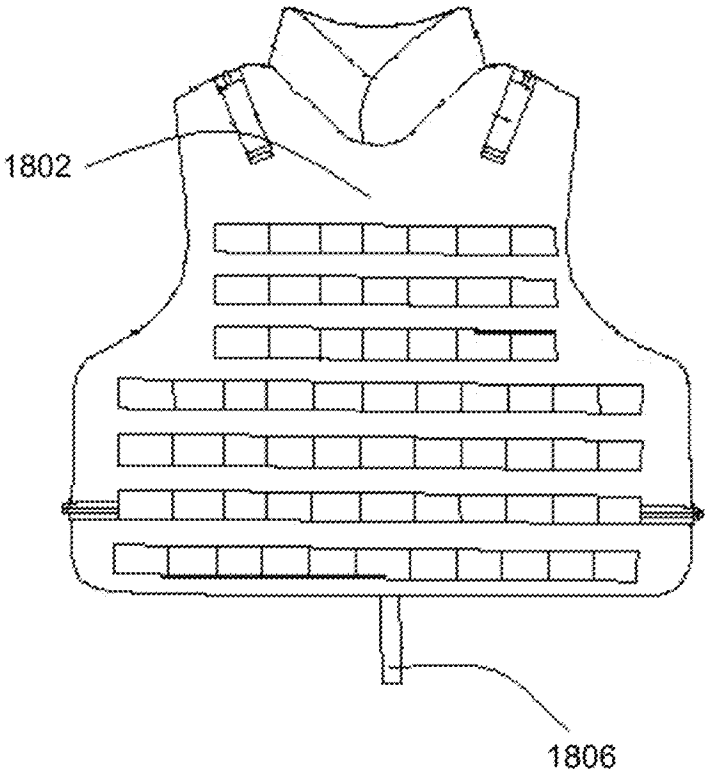
FIG. 23*a* illustrates a front view of a quickly releasable vest depicting used position of the self locking buckle assembly, according to an embodiment of the present invention(s)

Further, referring to FIG. 23*a* and FIG. 23*b* a quickly releasable vest 1800 including the self locking buckle assembly 1300 is disclosed. In various embodiments, the quickly releasable vest 1800 may be or comprise the vest 100 and/or the vest 700. As shown in the FIG. 23*a* and FIG. 23*b*, the wedge fork 1400 along with the ferrule 1500 and the elongated strip 1600 may be secured on one of a front torso panel 1802 or a rear torso panel 1804 and the socket member 1700 may be disposed on one of the front torso panel 1802 or the rear torso panel 1804 to which the wedge fork 1400 is not secured. Further, the elongated strip 1600 may be secured to a pull down sling 1806 of the bullet proof vest 1800. The pull down sling 1806 may be pulled downwards for the quick release of the self locking buckle assembly 1300.

In use, generally the wedge fork 1400 along with the ferrule 1500 and the elongated strip 1600 may be connected to one part of a device, such as the front torso of panel 1802 of the bullet proof vest 1800, and the socket member 1700 may be connected to another part of the device, such as the rear torso panel 1804, that is to be secured with the first part of the device, such as the front torso panel 1802 of the bullet roof vest 1800. Firstly, the wedge fork 1400 may be inserted in the socket member 1700 such that the prong 1416 of the pair of legs 1410 may be locked in the opening 1714 of the first side portion 1706 and the second side portion 1708 of the socket member 1700. In this way first locking is achieved between the prong 1416 of the pair of legs 1410 of the wedge fork 1400 and the socket member 1700. Further, the ferrule 1500 may be pushed away from the leg base portion 1414, i.e. in the upward direction, enables movement of the prong 1416 of the pair of legs 1410 away from each other. More specifically, upward movement of the pair of slide members 1518 towards the distal end portion 1424 enables locking of the pair of slide members 1518 in the distal end portion 1424 of the of the prong 1416 of the wedge fork 1400. Further, this locking of the pair of slide members 1518 in the distal end portion 1424 of the notch enables stronger locking of the prong 1416 of the pair of legs 1410 of the wedge fork 1400 and the socket assembly 1700. In this way the device, such as the bullet proof vest 1800, may withstand more load then without use of the self locking buckle assembly 1300.

Further, for releasing of the self locking buckle assembly 1300, the user may have to move the elongated strip 1600, in a downward direction or the direction towards the leg base portion 1414. Further, in one embodiment of the present invention, when the elongated strip 1600 is connected to the pull down sling 1806, downward movement or the movement towards the leg base portion 1414, of the pull down sling 1806 enables downward movement of the ferrule 1500. In such a way, the pair of slide members 1518 moves towards the leg base portion 1414 and thereby releasing of the locking of the pair of slide members 1518 in the distal end portion 1424 of the notch portion 1420 of the wedge fork 1400. Accordingly, further downward movement of the ferrule 1500 or further movement the pair of slide members 1518 moves towards the leg base portion 1414, enables movement of the prong 1416 towards each other and thereby releasing locking of the prong 1416 of the pair of legs 1410 with the opening 1714 of the first side portion 1706 and the second side portion 1708 of the socket member 1700. Accordingly, the wedge fork 1400 may be separated from the socket member 1700, and thereby separating the front torso of panel 1802 from the rear torso panel 1804.

Various embodiments of the present invention offer following advantages. The self locking buckle assembly, as described herein, is capable of being released quickly and at the same time connection provided by the self locking buckle assembly is strong. Further, the self locking buckle assembly is capable of being easily separated with limited motion of user's hands. Furthermore, the self locking buckle assembly is configured to prevent accidental release thereof. Still further, the self locking buckle assembly is simple in construction and easy to use.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

The invention claimed is:

1. A quickly releasable vest for protecting a torso portion of a user, the quickly releasable vest comprising:

a self locking buckle assembly, the self locking buckle assembly comprising:

a wedge fork, the wedge fork comprising, a base portion secured to a webbing;

a body portion, the body portion comprising, a pair of legs extending from the base portion, each of the pair of legs comprising a leg base portion and a prong, wherein the prong comprises a notch portion configured thereon, the notch portion including a proximal end portion and a distal end portion, the distal end portion having a lock; and a ferrule guide member extending from the base portion and disposed in between the pair of legs;

a ferrule adapted to be slidingly disposed on the ferrule guide member, the ferrule comprising a narrower end portion, a broader end portion extending from the narrower end portion, and a tape guide member, the ferrule configured to be locked to the notch by the lock of the distal end of the notch;

an elongated strip having a proximal end portion and a distal end portion, the proximal end portion connected to the tape guide member of the ferrule and the distal end portion adapted to be used for facilitating movement of the ferrule; and a socket member defining a hollow portion and comprising a first side portion and a second side portion, each of the first side portion and the second side portion comprising an opening configured thereon, wherein the opening is adapted to facilitate removable retaining and locking of the prong of the each of the pair of legs to the socket member, wherein the wedge fork in combination with the ferrule and the elongated strip is disposed on one of a front torso panel and a rear torso panel and the socket member disposed on other of the front torso panel and the rear torso panel for facilitating quick release of the quickly releasable vest.

2. The quickly releasable vest of claim 1, wherein the base portion is secured to the webbing with an eye hook.

3. The quickly releasable vest of claim 1, wherein the pair of legs is flexible.

4. The quickly releasable vest of claim 1, wherein the notch portion is configured on an operative upper surface of the prong.

5. The quickly releasable vest of claim 1, wherein the notch portion is configured to be arcuate in shape.

6. The quickly releasable vest of claim 1, wherein the ferrule guide member includes an elongated central notch portion configured thereon.

7. The quickly releasable vest of claim 1, wherein the narrower end portion of the ferrule comprises a first eye hook and a second eye hook, wherein the first eye hook is extending perpendicularly from an operative front face of the ferrule and the second eye hook is extending perpendicularly from an operative back face of the ferrule.

8. The quickly releasable vest of claim 1, wherein the broader end portion includes a third eye hook and a pair of slide members, wherein the third eye hook is configured to be extending perpendicularly from an operative back face of the ferrule, and, wherein each of the pair of slide members is extending perpendicularly from end portions of the broader end portion from the operative back face of the ferrule.

9. The quickly releasable vest of claim 8, wherein the ferrule is slidingly disposed on the ferrule guide member by means of the second eye hook and the third eye hook.

10. The quickly releasable vest of claim 8, wherein the broader end portion of the ferrule comprises a locking means disposed on either side thereof corresponding to a cut-out portion the distal end portion of the notch portion of the prong for facilitating removable locking with the prong.

11. The quickly releasable vest of claim 8, wherein the pair of slide members is configured to be slidingly disposed in the notch portion of the prong.

12. The quickly releasable vest of claim 11, wherein the sliding movement of the pair of slide members in the notch portion enables movement of the prong of the pair of legs.

13. The quickly releasable vest of claim 12, wherein movement of the pair of slide members towards the leg base portion enables movement of the prong of the pair of legs towards each other and movement of the pair of slide members away from the leg base portion enables movement of the prong of the pair of legs away from each other.

14. The quickly releasable vest of claim 7, wherein the distal end portion of the elongated strip is passed through the first eye hook of the ferrule and an eye hook of the wedge fork.

15. The quickly releasable vest of claim 1, wherein an upper portion of the socket member comprising a rectangular cut-out portion configured thereon for accommodating at least a portion of the ferrule.

16. The quickly releasable vest of claim 1, wherein the socket member comprises a second eye hook for facilitating securing of a webbing thereto.

* * * * *